US009587466B2

(12) United States Patent
Burguieres et al.

(10) Patent No.: US 9,587,466 B2
(45) Date of Patent: Mar. 7, 2017

(54) CEMENTING SYSTEM FOR RISERLESS ABANDONMENT OPERATION

(71) Applicant: Wild Well Control, Inc., Houston, TX (US)

(72) Inventors: Philip Martial Burguieres, Houston, TX (US); Corey Eugene Hoffman, Plantersville, TX (US); Stephen Paul Breaux, Seabrook, TX (US); Kenneth Thomas Wilke, Houston, TX (US)

(73) Assignee: Wild Well Control, Inc., Houston, TX (US)

( * ) Notice: Subject to any disclaimer, the term of this patent is extended or adjusted under 35 U.S.C. 154(b) by 0 days.

(21) Appl. No.: 14/851,106

(22) Filed: Sep. 11, 2015

(65) Prior Publication Data

US 2016/0076341 A1 Mar. 17, 2016

Related U.S. Application Data

(60) Provisional application No. 62/050,822, filed on Sep. 16, 2014.

(51) Int. Cl.
*E21B 33/10* (2006.01)
*E21B 41/00* (2006.01)
(Continued)

(52) U.S. Cl.
CPC ..... *E21B 41/0007* (2013.01); *E21B 33/00* (2013.01); *E21B 33/10* (2013.01); *E21B 33/13* (2013.01); *E21B 33/143* (2013.01)

(58) Field of Classification Search
CPC ..... E21B 41/0007; E21B 33/05; E21B 33/13; E21B 33/143
See application file for complete search history.

(56) References Cited

U.S. PATENT DOCUMENTS 2,947,250 A * 8/1960 Mohaupt ..... E21B 43/117 102/310
2,986,214 A * 5/1961 Wiseman, Jr. ..... E21B 43/116 102/310

(Continued)

FOREIGN PATENT DOCUMENTS

| | | | |
|---|---|---|---|
| EP | 1340882 | A2 | 9/2003 |
| EP | 2873801 | A1 | 5/2015 |
| GB | 2501381 | A | 10/2013 |

OTHER PUBLICATIONS

United Kingdom Combined Search and Examination Report dated Apr. 5, 2016, for UK Patent Application No. GB1516355.3.

*Primary Examiner* — Matthew R Buck
*Assistant Examiner* — Aaron Lembo
(74) *Attorney, Agent, or Firm* — Patterson & Sheridan, LLP

(57) ABSTRACT

A method for abandonment of a subsea well includes: setting a packer of a lower cementing tool against a bore of an inner casing at a location adjacent to an outer casing; fastening a pressure control assembly (PCA) to the subsea wellhead; hanging an upper cementing tool from the PCA and stabbing the upper cementing tool into a polished bore receptacle of the lower cementing tool; perforating a wall of the inner casing below the packer; perforating the inner casing wall above the packer by operating a perforator of the upper cementing tool; and pumping cement slurry followed by a release plug through bores of the cementing tools. The release plug engages and launches a cementing plug from the lower cementing tool. The cementing plug drives the cement slurry through the perforations below the packer and into an inner annulus formed between the inner casing and the outer casing.

18 Claims, 33 Drawing Sheets

(51) Int. Cl.

| | |
|---|---|
| ***E21B 33/00*** | (2006.01) |
| ***E21B 33/13*** | (2006.01) |
| ***E21B 33/14*** | (2006.01) |

(56) References Cited

U.S. PATENT DOCUMENTS 3,556,220 A * 1/1971 Schwegman ..... E21B 33/1294 166/120
4,384,615 A * 5/1983 Luers ..... B01F 5/0413 137/896
4,436,149 A * 3/1984 Edwards ..... E21B 33/1294 166/120
4,709,760 A * 12/1987 Crist ..... E21B 33/13 166/285
4,714,117 A * 12/1987 Dech ..... E21B 17/00 166/187
4,790,383 A * 12/1988 Savage ..... E21B 43/116 166/297
4,840,229 A * 6/1989 Proctor ..... E21B 23/006 166/217
5,372,198 A * 12/1994 North ..... E21B 29/12 166/363
5,373,899 A * 12/1994 Dore' ..... E21B 43/116 166/278
5,697,441 A * 12/1997 Vercaemer ..... E21B 33/124 166/285
5,954,133 A * 9/1999 Ross ..... E21B 17/07 166/297
6,003,599 A * 12/1999 Huber ..... E21B 43/119 166/255.2
6,056,053 A 5/2000 Giroux et al.
6,095,245 A * 8/2000 Mount ..... E21B 43/04 166/114
6,394,184 B2 * 5/2002 Tolman ..... E21B 17/203 166/120
6,446,727 B1 * 9/2002 Zemlak ..... E21B 17/20 166/177.5
6,715,543 B1 * 4/2004 Svindland ..... E21B 33/02 166/135
7,178,602 B2 2/2007 Hiorth et al.
9,027,651 B2 * 5/2015 Frisby ..... E21B 34/00 166/373
9,303,501 B2 * 4/2016 Fehr ..... E21B 33/124
2006/0065408 A1 * 3/2006 Green ..... B21D 17/04 166/384
2007/0163783 A1 * 7/2007 Head ..... E21B 33/13 166/368
2013/0269948 A1 10/2013 Hoffman et al.
2014/0083677 A1 3/2014 Stormo
2015/0021018 A1 * 1/2015 Tunget ..... E21B 41/0007 166/250.01
2015/0308208 A1 * 10/2015 Capps ..... E21B 29/08 166/285
2016/0102528 A1 * 4/2016 Wise ..... G06F 17/50 166/336

* cited by examiner 21
25
111
110
90
70
10

21
25
69
112
70
10

21
29
116
115b
114b
112
70
10

21
29
116
118
119
39
112
70
10

21
29
116
115c
114c
112
70
10

21
29
116
118
119
39
112
70
10

CEMENTING SYSTEM FOR RISERLESS ABANDONMENT OPERATION

BACKGROUND OF THE DISCLOSURE

Field of the Disclosure

The present disclosure generally relates to a cementing system for a riserless abandonment operation.

Description of the Related Art

FIGS. 1A-1C illustrate a prior art completed subsea well. A conductor string 3 may be driven into a floor if of the sea 1. The conductor string 3 may include a housing 3*h* and joints of conductor pipe 3*p* connected together, such as by threaded connections. Once the conductor string 3 has been set, a subsea wellbore 2 may be drilled into the seafloor if and extend into one or more upper formations 9*u*. A surface casing string 4 may be deployed into the wellbore 3. The surface casing string 4 may include a wellhead housing 4*h* and joints of casing 4*c* connected together, such as by threaded connections. The wellhead housing 4*h* may land in the conductor housing 3*h* during deployment of the surface casing string 4. The surface casing string 4 may be cemented 8*s* into the wellbore 2. Once the surface casing string 2 has been set, the wellbore 2 may be extended and an intermediate casing string 5 may be deployed into the wellbore. The intermediate casing string 5 may include a hanger 5*h* and joints of casing 5*c* connected together, such as by threaded connections. The intermediate casing string 5 may be cemented 8*i* into the wellbore 2.

Once the intermediate casing string 5 has been set, the wellbore 2 may be extended into and a hydrocarbon-bearing (i.e., crude oil and/or natural gas) reservoir 9*r*. The production casing string 6 may be deployed into the wellbore. The production casing string 6 may include a hanger 6*h* and joints of casing 6*c* connected together, such as by threaded connections. The production casing string 6 may be cemented 8*p* into the wellbore 2. Each casing hanger 5*h*, 6*h* may be sealed in the wellhead housing 4*h* by a packoff. The housings 3*h*, 4*h* and hangers 5*h*, 6*h* may be collectively referred to as a wellhead 10.

A production tree 15 may be connected to the wellhead 10, such as by a tree connector 13. The tree connector 13 may include a fastener, such as dogs, for fastening the tree to an external profile of the wellhead 10. The tree connector 13 may further include a hydraulic actuator and an interface, such as a hot stab, so that a remotely operated subsea vehicle (ROV) 20 (FIG. 2A) may operate the actuator for engaging the dogs with the external profile. The tree 15 may be vertical or horizontal. If the tree is vertical (not shown), it may be installed after a production tubing string 7 is hung from the wellhead 10. If the tree 15 is horizontal (as shown), the tree may be installed and then the production tubing string 7 may be hung from the tree 15. The tree 15 may include fittings and valves to control production from the wellbore 2 into a pipeline (not shown) which may lead to a production facility (not shown), such as a production vessel or platform.

The production tubing string 7 may include a hanger 7*h* and joints of production tubing 7*t* connected together, such as by threaded connections. The production tubing string 7 may further include a subsurface safety valve (SSV) 7*v* interconnected with the tubing joints 7*t* and a hydraulic conduit 7*c* extending from the valve 7*v* to the hanger 7*h*. The production tubing string 7 may further include a production packer 7*p* and the packer may be set between a lower end of the production tubing and the production casing string 6 to isolate an annulus 7*a* (aka the A annulus) formed therebetween from production fluid (not shown). The tree 15 may also be in fluid communication with the hydraulic conduit 7*c*. A lower end of the production casing string 6 may be perforated 11 to provide fluid communication between the reservoir 9*r* and a bore of the production tubing string 7. The production tubing string 7 may transport production fluid from the reservoir 9*r* to the production tree 15.

The tree 15 may include a head 12, the tubing hanger 7*h*, the tree connector 13, an internal cap 14, an external cap 16, an upper crown plug 17*u*, a lower crown plug 17*b*, a production valve 18*p*, one or more annulus valves 18*u,b*, and a face seal 19. The tree head 12, tubing hanger 7*h*, and internal cap 14 may each have a longitudinal bore extending therethrough. The tubing hanger 7*h* and head 12 may each have a lateral production passage formed through walls thereof for the flow of production fluid. The tubing hanger 7*h* may be disposed in the head bore. The tubing hanger 7*h* may be fastened to the head by a latch.

Once the reservoir 9*r* has been produced to depletion, the well must be abandoned. Conventionally, an abandonment operation includes cutting into the casings and filling the annuli with cement to seal the upper regions of the annuli. To achieve this, it is usual to use a semi-submersible drilling vessel (SSDV) which is located above the well and anchored in position. After removal of the cap 16 from the well, a unit including blow-out preventers and a riser is lowered and locked on to the wellhead. A tool string is run on pipe to sever or perforate the casing or casings. Weighted fluid is pumped into the well to provide a hydrostatic head to balance any possible pressure release when the casing is cut. The casing is then cut, and the annulus cemented. The cemented annulus is then pressure tested to ensure an adequate seal has been obtained. The casing is severed below the mud line and the casing hangers retrieved, and finally after removal from the well, the well is filled with cement. Whilst by this procedure satisfactory well abandonment can be achieved, it is expensive in terms of the equipment involved and the time taken which is often from seven to ten days per well.

SUMMARY OF THE DISCLOSURE

The present disclosure generally relates to a cementing system for a riserless abandonment operation. In one embodiment, a method for abandonment of a subsea well includes: setting a packer of a lower cementing tool against a bore of an inner casing hung from a subsea wellhead at a location adjacent to an outer casing hung from the subsea wellhead; fastening a pressure control assembly (PCA) to the subsea wellhead; hanging an upper cementing tool from the PCA and stabbing the upper cementing tool into a polished bore receptacle of the lower cementing tool; perforating a wall of the inner casing below the packer; perforating the inner casing wall above the packer by operating a perforator of the upper cementing tool; and pumping cement slurry followed by a release plug through bores of the cementing tools. The release plug engages and launches a cementing plug from the lower cementing tool. The cementing plug drives the cement slurry through the perforations below the packer and into an inner annulus formed between the inner casing and the outer casing.

In another embodiment, a system for abandonment of a subsea well includes an upper cementing tool and a lower cementing tool. The upper cementing tool includes: a hanger having an external seal and an external latch; a perforating gun connected to the hanger and having an igniter and charge carrier; and a stinger connected to the perforating gun. The lower cementing tool includes: a polished bore receptacle (PBR) for receiving the stinger; a packer connected to the PBR and having an expandable packing element and an anchor; and a wiper plug releasably connected to the plug nipple.

In another embodiment, a method for abandonment of a subsea well includes: setting a packer of a lower cementing tool against a bore of an inner casing hung from a subsea wellhead at a location adjacent to an outer casing hung from the subsea wellhead; fastening a pressure control assembly (PCA) to the subsea wellhead; hanging an upper cementing tool from the PCA and stabbing the upper cementing tool into a polished bore receptacle of the lower cementing tool; perforating a wall of the inner casing below the packer and adjacent to a lower end of the lower cementing tool; perforating the inner casing wall above the packer by operating a perforator of the upper cementing tool; and pumping cement slurry through bores of the cementing tools, through the perforations below the packer, and into an inner annulus formed between the inner casing and the outer casing.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIG. 6A illustrates deployment of a lower perforating gun of the annulus cementing system. FIG. 6B illustrates firing of the lower perforating gun to perforate the production casing. FIG. 6C illustrates deployment of a bore plug. FIG. 6D illustrates setting of the bore plug in the lower annulus cementing tool. FIG. 6E illustrates opening an isolation sleeve of the upper annulus cementing tool. FIG. 6F illustrates firing of a perforating gun of the upper annulus cementing tool to again perforate the production casing. FIG. 6G illustrates retrieval of the bore plug from the lower annulus cementing tool. FIG. 6H illustrates pumping cement slurry into the annulus. FIG. 6I illustrates launching of a cementing plug of the lower annulus cementing tool.

FIG. 7A illustrates deployment of a second lower perforating gun of the annulus cementing system. FIG. 7B illustrates firing of the second lower perforating gun to perforate the production and intermediate casing strings. FIG. 7C illustrates redeployment of the bore plug. FIG. 7D illustrates again setting the bore plug in the lower annulus cementing tool. FIG. 7E illustrates opening a second isolation sleeve of the upper annulus cementing tool. FIG. 7F illustrates firing of a second perforating gun of the upper annulus cementing tool to again perforate the production and intermediate casing strings. FIG. 7G illustrates repeat retrieval of the bore plug from the lower annulus cementing tool. FIG. 7H illustrates pumping cement slurry into the annulus. FIG. 7I illustrates again setting the bore plug in the lower annulus cementing tool.

FIG. 8A illustrates deployment of an upper bridge plug. FIG. 8B illustrates setting the upper bride plug in the production casing. FIG. 8C illustrates cement plugging a bore of the production casing.

DETAILED DESCRIPTION

Figure 1A:
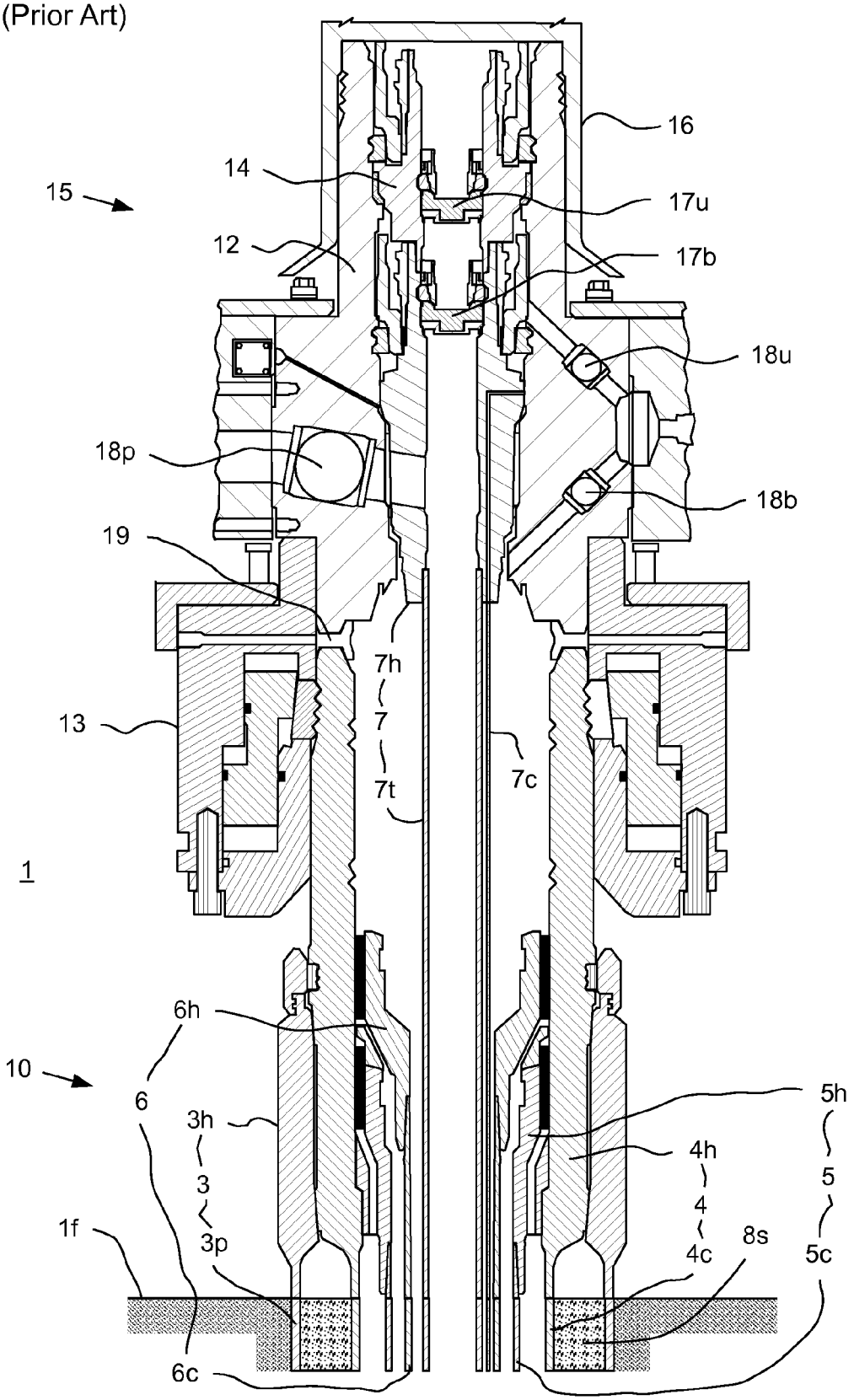
FIG. 1A (Prior Art)
FIGS. 1A-1C illustrate a prior art completed subsea well.
Figures 1B, 1C:
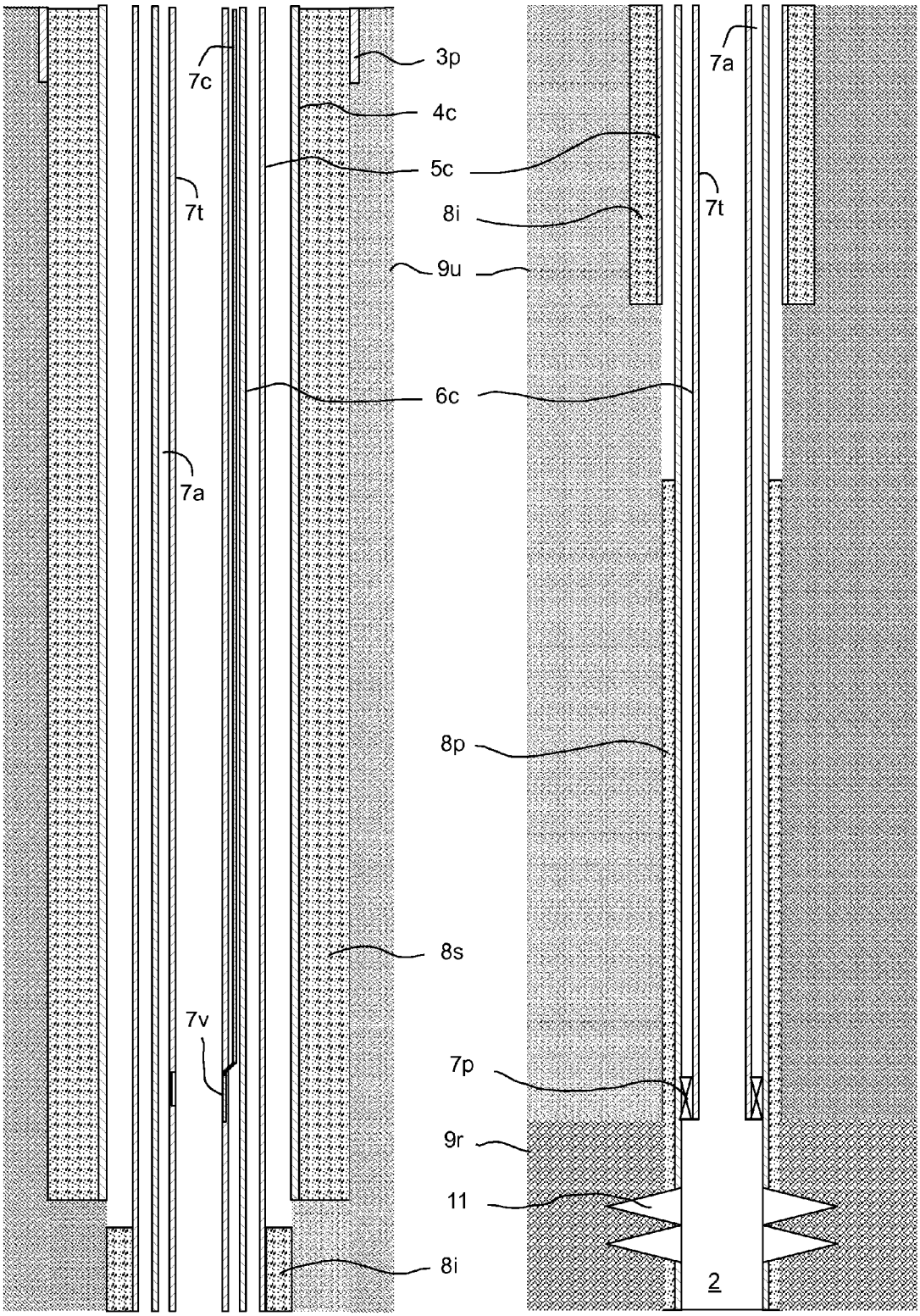
FIG. 1B (Prior Art)
FIG. 1C (Prior Art)
Figure 2A:
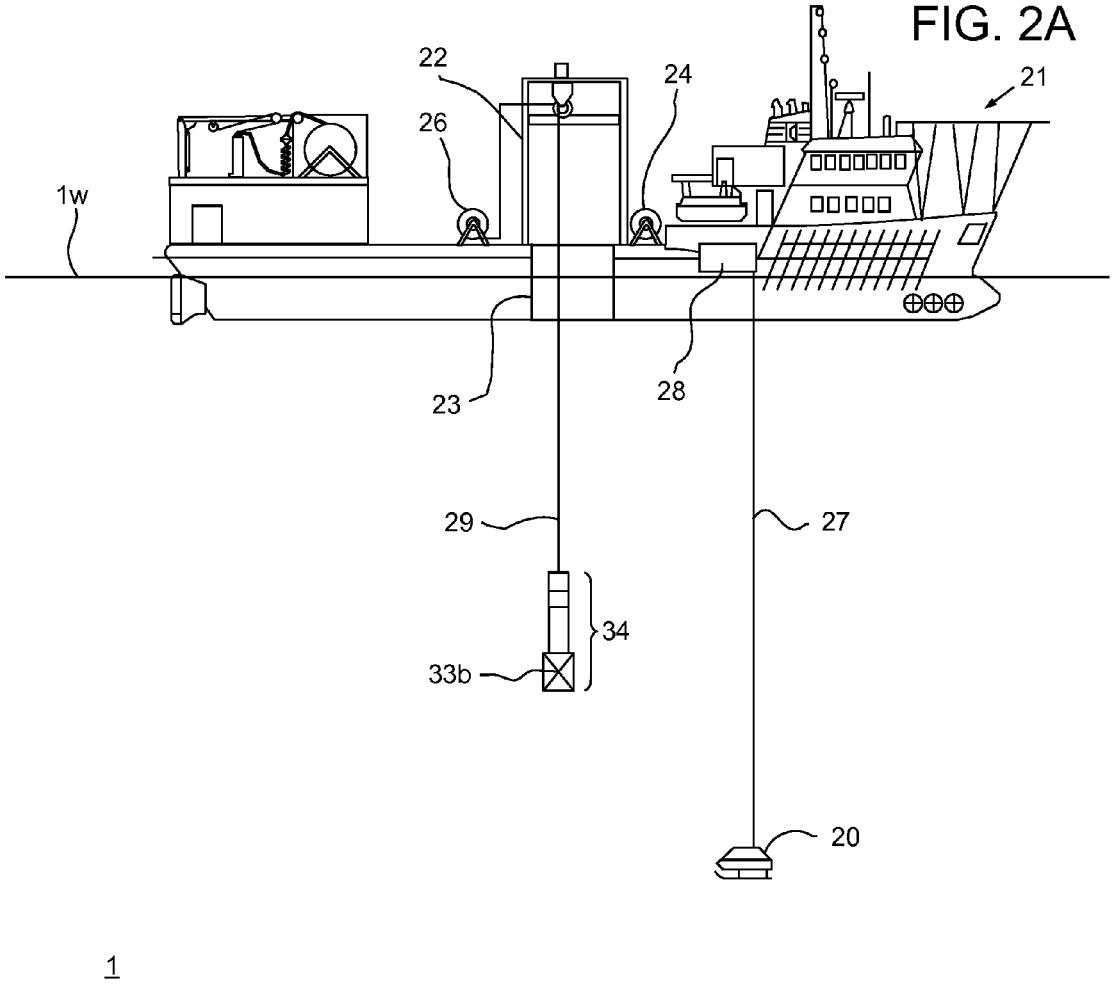
FIGS. 2A-2C illustrate deployment of a lower bridge plug to commence abandonment of an upper portion of the well after abandonment of a lower portion of the well, according to one embodiment of the present disclosure.
Figure 2A:
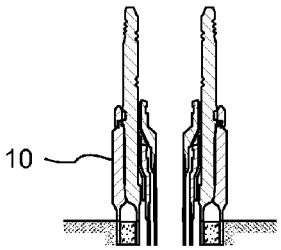
Figures 2B, 2C:
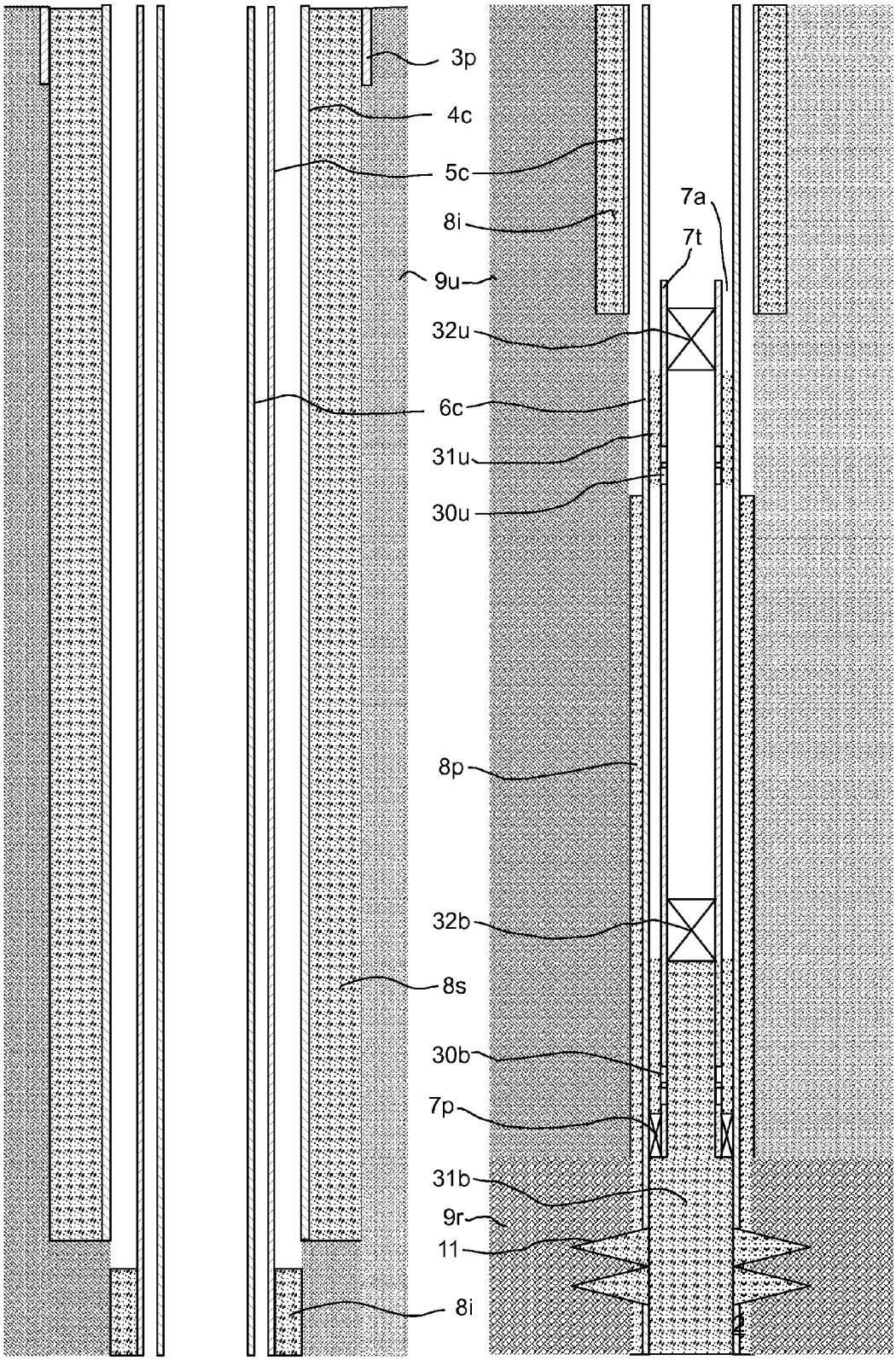
Figure 2D:
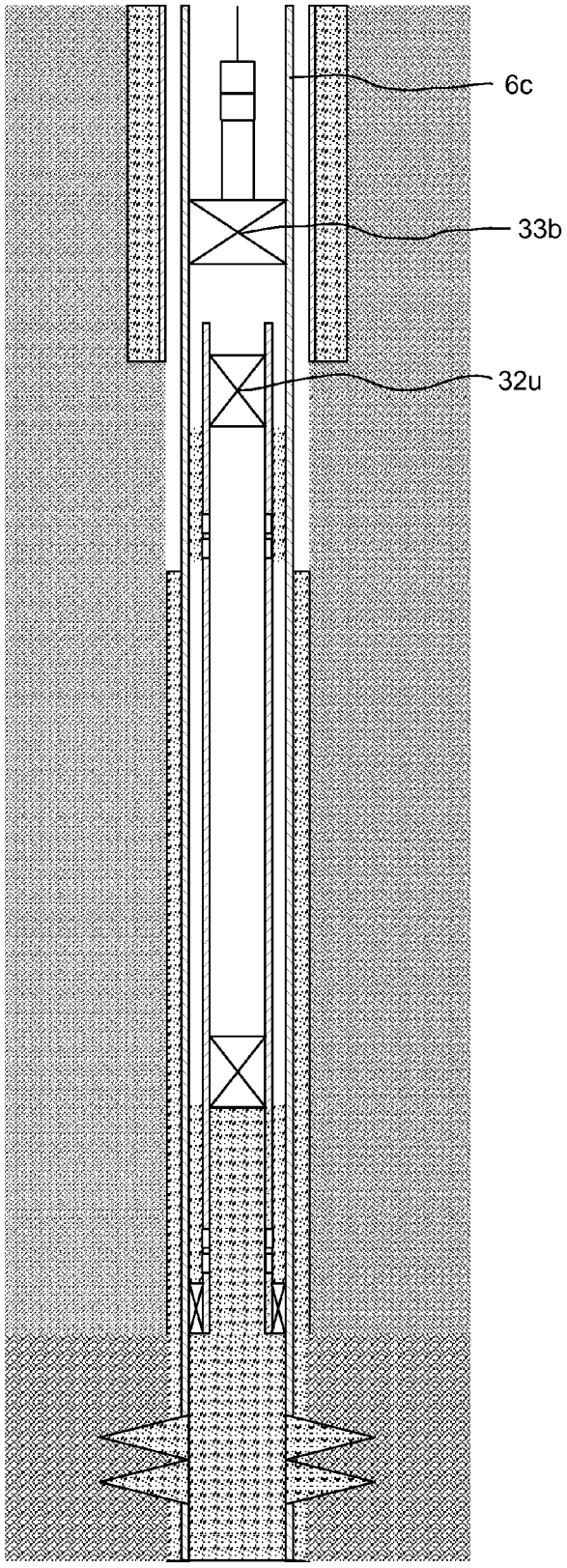
FIG. 2D illustrates setting the lower bride plug in the production casing string of the well.

FIGS. 2A-2C illustrate deployment of a lower bridge plug 33*b* to commence abandonment of an upper portion of the well after abandonment of a lower portion of the well, according to one embodiment of the present disclosure. FIG. 2D illustrates setting the lower bride plug 33*b* in the production casing string 6 of the well.

To abandon the lower portion of the well, a support vessel 21 may be deployed to a location of the subsea tree 15. The support vessel 21 may be a light or medium intervention vessel and include a dynamic positioning system to maintain position of the vessel 21 on the waterline 1*w* over the tree 15 and a heave compensator (not shown) to account for vessel heave due to wave action of the sea 1. The vessel 21 may further include a tower 22 located over a moonpool 23 and a winch 24. The winch 24 may include a drum having wire rope 25 (FIG. 4B) wrapped therearound and a motor for winding and unwinding the wire rope, thereby raising and lowering a distal end of the wire rope relative to the tower 22. The vessel 21 may further include a wireline winch 26.

Alternatively, the vessel 21 may be a mobile offshore drilling unit (MODU). Alternatively, a crane (not shown) may be used instead of the winch and tower.

The ROV 20 may be deployed into the sea 1 from the vessel 21. The ROV 20 may be an unmanned, self-propelled submarine that includes a video camera, an articulating arm, a thruster, and other instruments for performing a variety of tasks. The ROV 20 may further include a chassis made from a light metal or alloy, such as aluminum, and a float made from a buoyant material, such as syntactic foam, located at a top of the chassis. The ROV 20 may be connected to support vessel 21 by an umbilical 27. The umbilical 27 may provide electrical (power), hydraulic, and data communication between the ROV 20 and the support vessel 21. An operator on the support vessel 21 may control the movement and operations of ROV 20. The ROV umbilical 27 may be wound or unwound from drum 28.

The ROV 20 may be deployed to the tree 15. The ROV 20 may transmit video to the ROV operator for inspection of the tree 15. The ROV 20 may remove the external cap 16 from the tree 15 and carry the cap to the vessel 21. The ROV 20 may then inspect an internal profile of the tree 15. The wire rope 25 may then be used to lower a pressure control head (not shown) to the tree 15 through the moonpool 23 of the vessel 21. The ROV 20 may guide landing of the pressure control head onto the tree 15.

Alternatively, the winch 24 may be used to transport the external cap 16 to the waterline 1*w*.

A seal head (not shown) may then be deployed through the moonpool 23 using the wireline winch 26 and landed on the pressure control head. A plug retrieval tool (PRT) (not shown) may be released from the seal head and electrical power supplied to the PRT via wireline 29, thereby operating the PRT to remove the crown plugs 17*u,b*. A tree saver (not shown) may or may not then be installed in the production tree 15 using a modified PRT. Once the crown plugs 17*u,b* have been removed from the tree 15, a bottomhole assembly (BHA) (not shown) may be connected to the wireline 29 and the seal head deployed to the pressure control head. The BHA may include a cablehead, a collar locator, and a perforator, such as a perforating gun.

Once the seal head has landed on the pressure control head, the SSV 7*v* may be opened and the BHA may be deployed into the wellbore 2 using the wireline 29. The BHA may be deployed to a depth adjacent to and above the production packer 7*p*. Once the BHA has been deployed to the setting depth, electrical power may then be supplied to the BHA via the wireline 29 to fire the perforating gun into the production tubing 7*t*, thereby forming lower perforations 30*b* through a wall thereof. The BHA may be retrieved to the seal head and the seal head dispatched from the pressure control head to the vessel 21. The lower annulus valve 18*b* may then be opened.

Cement slurry (not shown) may then be pumped from the vessel 21, through the pressure control head, down the production tree 15 and production tubing 7*t*, and into the tubing annulus 7*a* via the lower perforations 30*b*. Wellbore fluid displaced by the cement slurry may flow up the tubing annulus 7*a*, through the wellhead 10, tree annulus port, and to the vessel 21. Once a desired quantity of cement slurry has been pumped into the tubing annulus 7*a*, the lower annulus valve 18*b* may be closed while continuing to pump the cement slurry, thereby squeezing cement slurry into the reservoir 9*r*. Once pumped, the cement slurry may be allowed to cure for a predetermined amount of time, such as one hour, six hours, twelve hours, or one day, thereby forming a lower cement plug 31*b*.

Once the lower cement plug 31*b* has cured, a second BHA (not shown) may be connected to the wireline 29 and the seal head and deployed to the pressure control head. The second BHA may include a cablehead, a collar locator, a setting tool, and a lower bridge plug 32*b*. The second BHA may be deployed to a depth adjacent to and above the lower cement plug 31*b*. Once the second BHA has been deployed to the setting depth, electrical power may then be supplied to the second BHA via the wireline 29 to operate the setting tool, thereby expanding the lower bridge plug 32*b* against an inner surface of the production tubing 7*t*. Once the lower bridge plug 32*b* has been set, the plug may be released from the setting tool. The setting tool may then be retrieved to the seal head and the seal head and setting tool dispatched from the pressure control head to the vessel 21.

The BHA may then be redeployed to the pressure control head and into the wellbore 2 using the wireline 29. The BHA may be redeployed to a depth below a shoe of the intermediate casing string 5 and above a top of the production casing cement 8*p*. Once the BHA has been deployed to the setting depth, electrical power may then be supplied to the BHA via the wireline 29 to fire the perforating guns into the production tubing 7*t*, thereby forming upper perforations 30*u* through a wall thereof. The BHA may be retrieved to the seal head and the seal head and BHA dispatched from the pressure control head to the vessel 21.

Cement slurry (not shown) may then be pumped from the vessel 21, through pressure control head, down the production tree 15 and production tubing 7*t*, and into the A annulus 7*a* via the upper perforations 30*u*. Wellbore fluid displaced by the cement slurry may flow up the A annulus 7*a*, through the wellhead 10, tree annulus port, and to the vessel 21. Once a desired quantity of cement slurry has been pumped, the cement slurry may be allowed to cure, thereby forming an upper cement plug 31*u*.

Once the upper cement plug 31*u* has cured, the second BHA may be reconnected to the wireline 29 and seal head and redeployed to the pressure control head. The second BHA may be redeployed to a depth adjacent to and above the upper cement plug 31*u*. Once the second BHA has been deployed to the setting depth, the upper bridge plug 32*u* may be set against the inner surface of the production tubing 7*t*. Once the upper bridge plug 32*u* has been set, the plug may be released from the setting tool and the second BHA may then be retrieved to the seal head and the seal head dispatched from the pressure control head to the vessel 21.

A third BHA (not shown) may then be connected to the wireline 29 and seal head and deployed to the pressure control head. The third BHA may include a cablehead, a collar locator, an anchor, a hydraulic power unit (HPU), an electric motor, and a tubing cutter. The third BHA may be deployed into the production tubing string 7 to a depth adjacent to and above the upper bridge plug 32*u*. Once the third BHA has been deployed to the cutting depth, the HPU may be operated by supplying electrical power via the wireline 29 to extend blades of the tubing cutter and the motor operated to rotate the extended blades, thereby severing an upper portion of the production tubing string 7 from a lower portion thereof.

Alternatively, the tubing cutter may be a thermite torch.

The third BHA may then be retrieved to the seal head and the seal head and third BHA dispatched from the pressure control head to the vessel 21. Once the third BHA and seal head have been retrieved to the vessel 21, the pressure control head may be disconnected from the tree 15 and retrieved to the vessel. A tree grapple (not shown) may be connected to the wire rope 25 and lowered from the vessel 21 into the sea 1 via the moon pool 23. The ROV 20 may guide landing of the tree grapple onto the tree 15. The ROV 20 may then operate a connector of the tree grapple to fasten the grapple to the tree 15. The ROV 20 may then disengage the tree connector 13 from the wellhead 10 and the production tree 15 and the severed upper portion of the production tubing string 7 may be lifted to the vessel 21 by operating the winch 24.

Once the production tree 15 has been retrieved to the vessel 21, a fourth BHA 34 may be connected to the wireline 29 and deployed through the open sea 1 to the subsea wellhead 10. The fourth BHA 34 may include a cablehead, a collar locator, a setting tool, and the lower bridge plug 33*b*. The setting tool may include a mandrel and a piston longitudinally movable relative to the mandrel. The setting mandrel may be connected to the collar locator and fastened to a mandrel of the lower bridge plug 33*b*, such as by a shearable fastener. The setting tool may include a firing head and a power charge. The firing head may receive electrical power from the wireline 29 to operate an electric match thereof and fire the power charge. Combustion of the power charge may create high pressure gas which exerts a force on the setting piston. The lower bridge plug 33*b* may include a mandrel, an anchor, and a packing element. The mandrel and anchor may be made from a metal or alloy, such as cast iron, and the packing element may be made from an elastomer or elastomeric copolymer. The anchor and packing element may be disposed along an outer surface of the plug mandrel between a setting shoulder of the mandrel and a setting ring. The setting piston may engage the setting ring and drive the packing and anchor against the setting shoulder, thereby setting the lower bridge plug 33*b*.

The fourth BHA 34 may be lowered through the subsea wellhead 10 into the production casing 6*c* and deployed to a depth therein adjacent to and above the upper bridge plug 32*u*. Once the fourth BHA 34 has been deployed to the setting depth, electrical power may then be supplied to the BHA via the wireline 29 to operate the setting tool, thereby expanding the lower bridge plug 33*b* against an inner surface of the production casing 6*c*. Once the lower bridge plug 33*b* has been set, the plug may be released from the setting tool by exerting tension on the wireline 29 to fracture the shearable fastener. The fourth BHA 34 (minus the lower bridge plug 33*b*) may then be retrieved to the vessel 21.

Figure 3A:
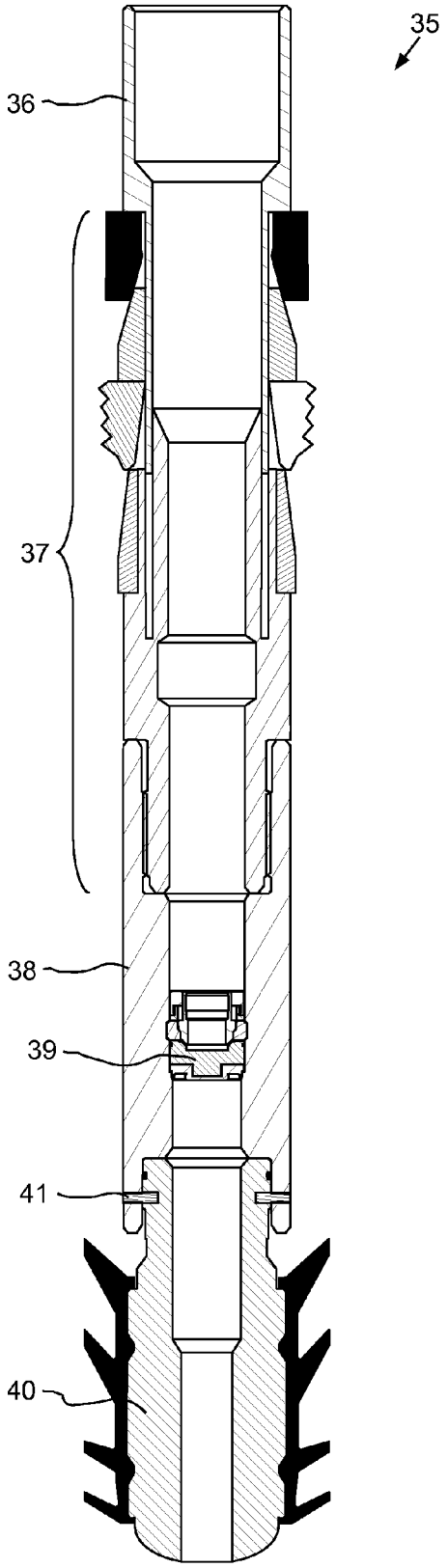
FIGS. 3A-3C illustrate a lower annulus cementing tool of the annulus cementing system.
Figure 3B:
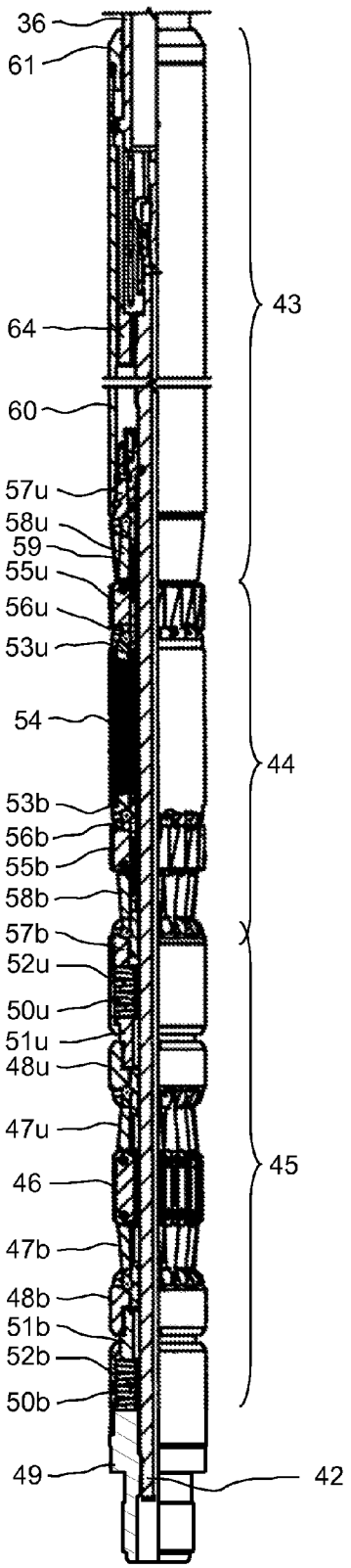
Figure 3C:
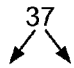
Figure 3C:
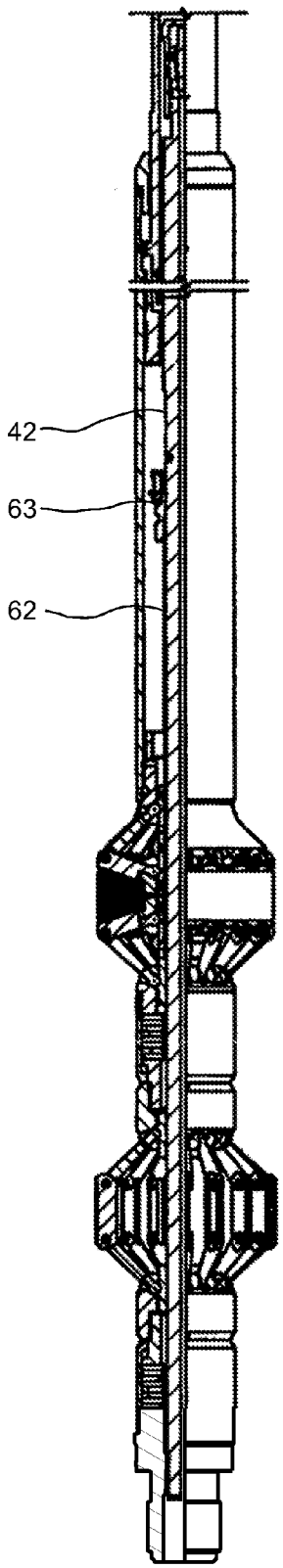

FIGS. 3A-3C illustrate a lower annulus cementing tool 35 of the annulus cementing system. The lower annulus cementing tool 35 may include a polished bore receptacle (PBR) 36, a packer 37, a nipple 38, a bore plug 39, and a cementing plug 40. The PBR 36 may be tubular, have seal bore formed at an upper end thereof, and have a coupling, such as a thread, formed adjacent to a lower end thereof.

The packer 37 may include a mandrel 42, a setting unit 43, a packing unit 44 and an anchor unit 45. The anchor unit 45 may include a set of metallic grippers 46 radially movable between an extended position (FIG. 3C) and a retracted position (FIG. 3B) and having teeth formed on an outer surface thereof for engagement with an inner surface of the production casing 6*c*. A respective end of each gripper 46 may be fastened to respective upper 48*u* and lower 48*b* retainers via upper 47*u* and lower 47*b* pivotal links. The grippers 46 may be longitudinally connected to the pivotal links 47*u,b*, such as by fasteners. The pivotal links 47*u,b* may be longitudinally connected to the retainers 48*u,b*, such as by ball and socket joints. Each retainer 48*u,b* may be a ring assembly disposed around an outer surface of the mandrel 42 and longitudinally movable relative thereto.

To guide extension of the anchor unit 45, each pivotal link 47*u,b* may have a cam profile formed in a face thereof adjacent to the grippers 46 and the grippers may each have complementary cam profiles formed in upper and lower faces thereof. The anchor unit 45 may also be arranged such that a slight inclination angle exists in the retracted position. The inclination angle may be formed between a longitudinal axis of each pivotal link 47*u,b* and a transverse axis of the respective fastener connecting the link to the respective gripper 46.

The packer 37 may further include an adapter 49 connected to a lower end of the mandrel 42, such as by threads secured with a fastener. The adapter 49 may be tubular and have a coupling, such as a threaded box (not shown) or pin (shown), formed at a lower end thereof. A top of the adapter 49 may serve as a stop shoulder for the anchor unit 45. The anchor unit 45 may further include upper 50*u* and lower 50*b* springs. Each spring 50*u,b* may be a compression spring, such as a Belleville spring. The lower spring 50*b* may have a lower end bearing against a top of the adapter 49 and an upper end bearing against a bottom of a lower spring washer 51*b*. A spring chamber may be formed radially between an outer surface of the mandrel 42 and an inner surface of a lower protector sleeve 52*b*. The lower protective sleeve 52*b* may be connected to the adapter 49, such as by threaded couplings, and be coupled to the lower spring washer 51*b*, such as by a splice joint. The splice joint may accommodate operation of the lower spring 50*b*. The lower spring washer 51*b* may be connected to the lower link retainer 48*b*, such as by threaded couplings.

An upper spring washer 51*u* may be connected to the upper link retainer 48*u*, such as by threaded couplings. An upper protective sleeve 52*u* may be coupled to the upper spring washer 51*u*, such as by a splice joint. The upper spring 50*u* may be disposed in a spring chamber formed between the upper protective sleeve 52*u* and the mandrel 42 and the splice joint may accommodate operation thereof. The upper spring 50*u* may have a lower end bearing against a top of the upper spring washer 51*u*.

The packing unit 44 may include a packing element 54 and a pair of glands 53*u,b* straddling the packing element. Each longitudinal end of the packing element 54 may be attached to the respective gland 53*u,b*. The packing element 54 may be made from an expandable material, such as an elastomer or elastomeric copolymer. The packing element 54 may be naturally biased toward a contracted position (FIG. 3B) and compression of the packing element between the glands 53*u,b* may radially expand (FIG. 3C) the packing element into engagement with an inner surface of the production casing 6*c*, thereby isolating a lower portion of a working annulus 67 (FIG. 3E) formed between the lower cementing tool 37 and the production casing 6*c* from an upper portion thereof. The packing unit 44 may further include strands of fiber extending between the glands for reinforcing the packing element 54.

The packing unit 44 may further include upper 55*u* and lower 55*b* sets of backup rings located adjacent to the respective glands 53*u,b*. An end of each backup ring 55*u,b* adjacent to the respective gland 53*u,b* may be longitudinally connected to respective sliders 56*u,b*, such as ball and socket joints. A distal end of each backup ring 55*u,b* may be fastened to the respective upper 57*u* and lower 57*b* retainers via upper 58*u* and lower 58*b* pivotal links. The backup rings 55*u,b* may be longitudinally connected to the pivotal links 58*u,b*, such as by fasteners. The pivotal links 58*u,b* may be longitudinally connected to the retainers 57*u,b*, such as by ball and socket joints. Each retainer 57*u,b* may be a ring assembly disposed around an outer surface of the mandrel 42 and longitudinally movable relative thereto.

The upper spring 50*u* may have an upper end bearing against a bottom of the lower link retainer 57*b*. The upper protective sleeve 52*u* may be connected to the lower link retainer 57*b*, such as by threaded couplings. The packing unit 44 may further include a flexible shroud 59 covering the upper pivotal links 58*u*. The shroud 59 may have a bead formed in an inner surface thereof received in a groove formed in an outer surface of the upper link retainer 57*u*, thereby longitudinally connecting the two members. Each backup ring 55*u,b* may have a support face for receiving a respective end face of the packing element 54 in the expanded position and a pocket for receiving an end face of the respective gland 53*u,b* in the expanded position.

The setting unit 43 may include an outer sleeve 60, a cap 61, an inner sleeve 62, an anchor lock 63, and a packing lock 64. The cap 61 may be connected to an upper end of the outer sleeve 60, such as by threaded couplings. The outer sleeve 60 may also have a coupling, such as a thread, for receiving the threaded lower end of the PBR 36, thereby connecting the members. The mandrel 42 may have a latch profile formed in an inner surface thereof for engagement with a latch of a setting tool 65 (FIG. 3E). A lower end of the outer sleeve 60 may be connected to the upper link retainer 57*u*, such as by threaded couplings.

The anchor lock 63 may include a body connected to an upper end of the inner sleeve 62, such as by threaded couplings, and releasably connected to the upper link retainer 57*u*, such as by a shearable fastener. The inner sleeve 62 may be disposed between the mandrel 42 and the packing unit 44 and extend along an outer surface of the mandrel such that an outer lug formed at a lower end of the inner sleeve is located adjacent to the lower link retainer 57*b*. The packing lock 64 may include a ratchet ring connected to the outer sleeve 60 and a ratchet profile formed in an outer surface of the mandrel 42.

The anchor lock 63 may further include a friction disk disposed along a plurality (only one shown) of threaded fasteners engaged with respective threaded sockets formed in a top of the body. The body top may be sloped and the fasteners may have different lengths to accommodate the slopes. Each fastener may carry a spring, such as a compression spring, bearing against an upper face of the friction disk and a head of the respective fastener. Each spring may have a different stiffness such that the friction disk is biased toward a cambered position, thereby locking the inner sleeve 62 to the mandrel 42. The friction disk may initially be held in a straight position by engagement with a top of the upper link retainer 57*u*, thereby allowing relative movement between the inner sleeve 62 and the mandrel 42.

The nipple 38 may be tubular, have a coupling, such as a threaded box (shown) or pin (not shown), formed at an upper end thereof and in engagement with the adapter coupling, thereby connecting the nipple and the packer 37. The nipple 38 may also may have a receiver profile formed in an inner surface thereof, and may have a coupling, such as a lap, formed in a lower end thereof. The bore plug 39 may include a body with a metallic seal on its lower end. The metallic seal may be a depending lip that engages the nipple receiver profile. The plug body may have a plurality of windows which allow fasteners, such as dogs, to extend and retract. The dogs may be pushed outward by an actuator, such as a central cam. The cam may have a retrieval profile formed in an inner surface thereof. The cam may move between a lower locked position and an upper position freeing the dogs to retract. A retainer, such as a nut, may connect to the upper end of the plug body to retain the cam. The extended dogs may engage the nipple receiver profile to fasten the bore plug 39 to the nipple 38.

The cementing plug 40 may be a wiper plug including a finned seal and a plug body. The finned seal may be made from an elastomer or elastomeric copolymer and attached to an outer surface of the plug body. The plug body may be tubular, may be made from a metal or alloy, may have an upper stem portion, and may have a seat formed in an inner surface thereof. The stem portion may be received by the nipple lap and one or more (pair shown) shearable fasteners 41 may be inserted into respective sockets formed through a wall of the nipple 38 and received by respective indentations formed in an outer surface of the stem portion, thereby releasably connecting the cementing plug 40 and the nipple.

Figure 3D:
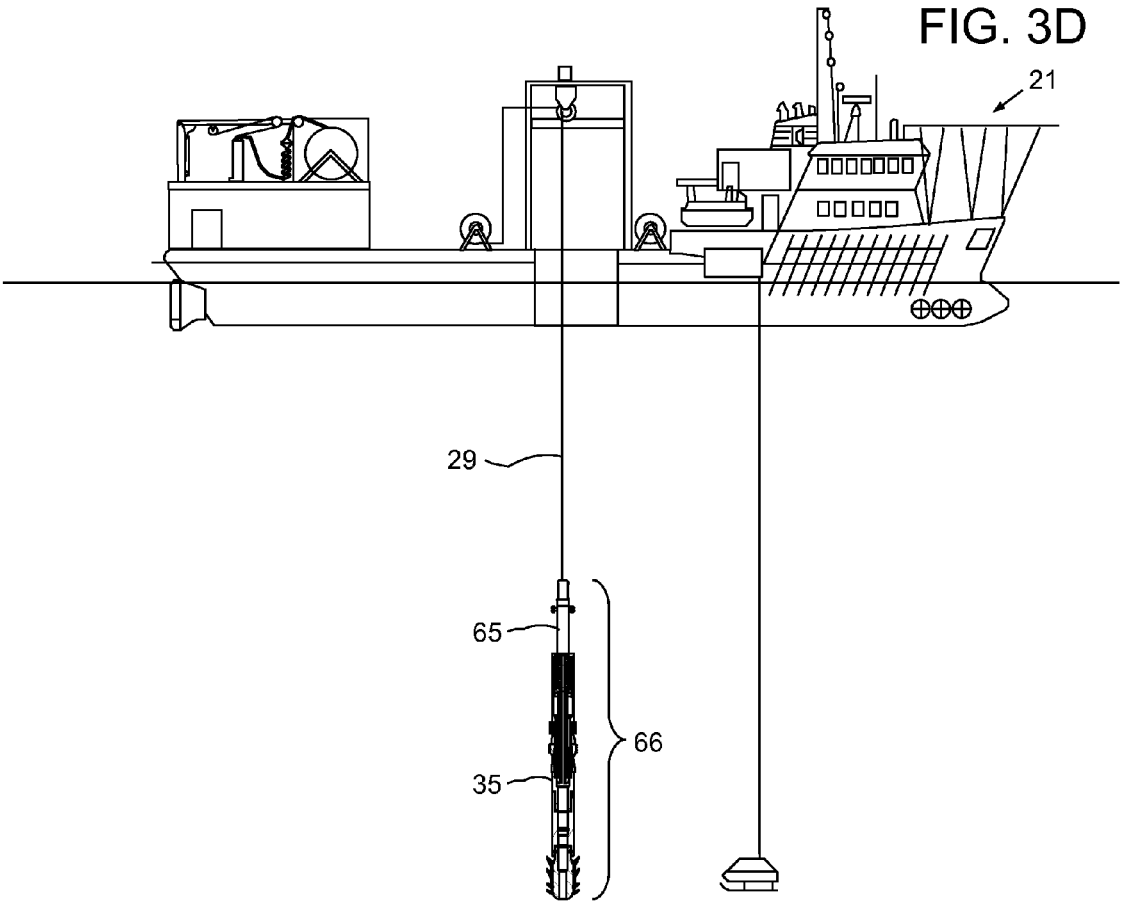
FIG. 3D illustrates deployment of the lower annulus cementing tool.
Figure 3D:
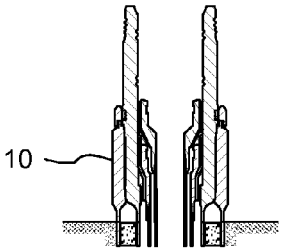
Figure 3E:
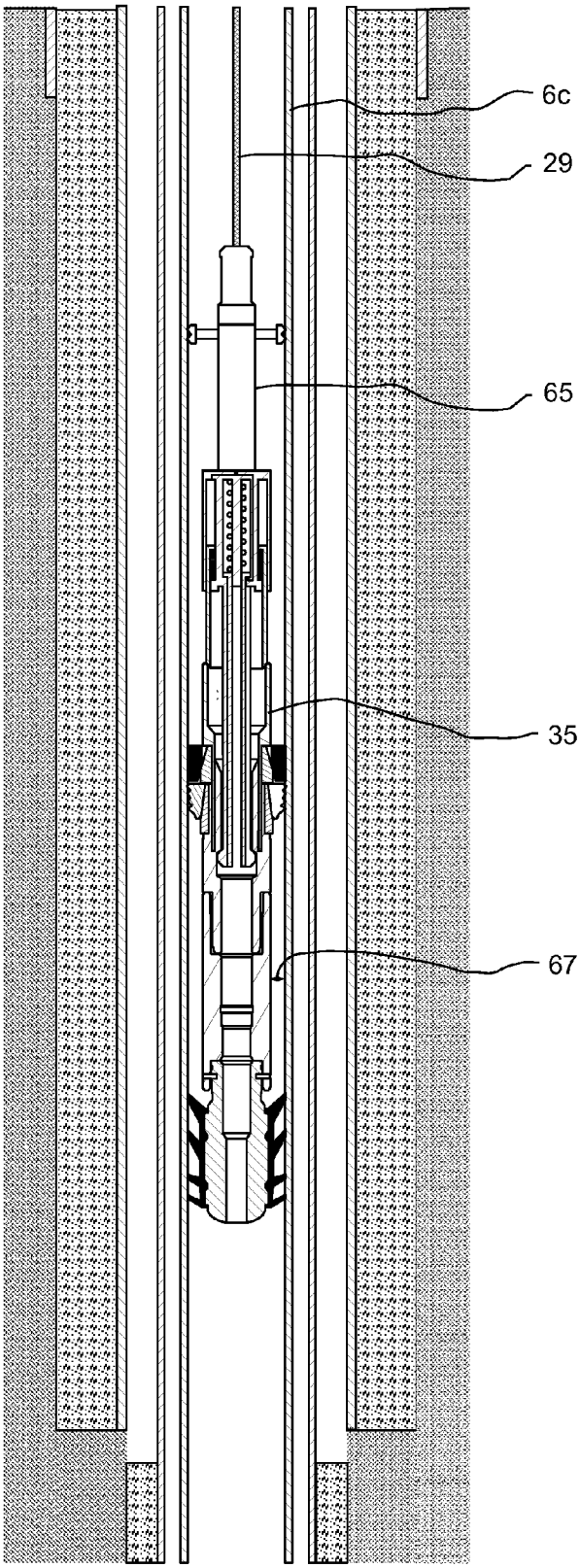
FIG. 3E illustrates setting of the lower annulus cementing tool in the production casing.

FIG. 3D illustrates deployment of the lower annulus cementing tool 35. FIG. 3E illustrates setting of the lower annulus cementing tool 35 in the production casing 6*c*. Once the lower bridge plug 33*b* has been set in the production casing 6*c*, a fifth BHA 66 may be connected to the wireline 29 and deployed through the open sea 1 to the subsea wellhead 10. The fifth BHA 66 may include a cablehead, a collar locator, the setting tool 65, and the lower annulus cementing tool 35 minus the bore plug 39.

The setting tool 65 may be tubular and include a stroker, an HPU, a cablehead, an anchor, and a latch. The stroker, HPU, cablehead, and anchor, may each include a housing connected, such as by threaded connections. The stroker may include the housing and a shaft. The cablehead may include an electronics package (not shown) for controlling operation of the setting tool 65. The electronics package may include a programmable logic controller (PLC) having a transceiver in communication with the wireline 29 for transmitting and receiving data signals to the vessel 21. The electronics package may also include a power supply in communication with the PLC and the wireline 29 for powering the HPU, the PLC, and various control valves. The HPU may include an electric motor, a hydraulic pump, and a manifold. The manifold may be in fluid communication with the various setting tool components and include one or more control valves for controlling the fluid communication between the manifold and the components. Each control valve actuator may be in communication with the PLC. The cablehead may connect the setting tool 65 to the wireline 29. The anchor may include two or more radial piston and cylinder assemblies and a die connected to each piston or two or more slips operated by a slip piston.

A housing of the latch may be fastened to the stroker shaft, such as by a threaded connection. The latch may further include a fastener, such as a collet, connected to an end of the housing. The latch may further include a locking piston disposed in a chamber formed in the housing and operable between a locked position in engagement with the collet and an unlocked position disengaged from the collet. The locking piston may be biased toward the locked position by a spring, such as a compression spring. The locking piston may be in fluid communication with the HPU via a passage formed through the housing, a passage (not shown) formed through the shaft and via a hydraulic swivel (not shown) disposed between the stroker housing and shaft. The latch may further include a release piston disposed in a chamber formed in the housing and operable between an extended position in engagement with the latch profile of the packer mandrel 42 and a retracted position to allow disengagement of the collet. The release piston may be biased toward the retracted position by a spring member, such as a compression spring. The release piston may also be in fluid communication with the HPU via a passage formed through the housing, a second passage (not shown) formed through the shaft and via the hydraulic swivel.

Alternatively, flexible conduit and/or flexible cable may be used instead of the hydraulic swivel.

The fifth BHA 66 may be lowered though the subsea wellhead 10 and along the production casing 6*c* to a depth above the lower bridge plug 33*b*. Once the fifth BHA 66 has been deployed to the setting depth, electrical power may be supplied to the BHA via the wireline 29 to operate the setting tool 65, thereby setting the anchor thereof and operating the stroker to push the PBR 36, the setting unit 43, the packing unit 44, and an upper portion of the anchor unit 45 downward along the mandrel 42 which is held stationary by the engaged setting tool anchor. Once the grippers 46 have been extended against an inner surface of the production casing 6*c*, the shearable fastener of the setting unit 43 may fracture, thereby releasing the packing unit 44 from the anchor unit. The PBR 36, outer sleeve 60, and an upper portion of the packing unit 44 may continue to be pushed downward until the packing element 54 has expanded against the inner surface of the production casing 6*c*.

Once the packer 37 has been set, the lower annulus cementing tool 35 may be released from the setting tool 65 by operation of the release piston and retraction of the stroker. The setting tool anchor may then be released and the fifth BHA 66 (minus the lower annulus cementing tool 35) retrieved to the vessel 21.

Figure 4A:
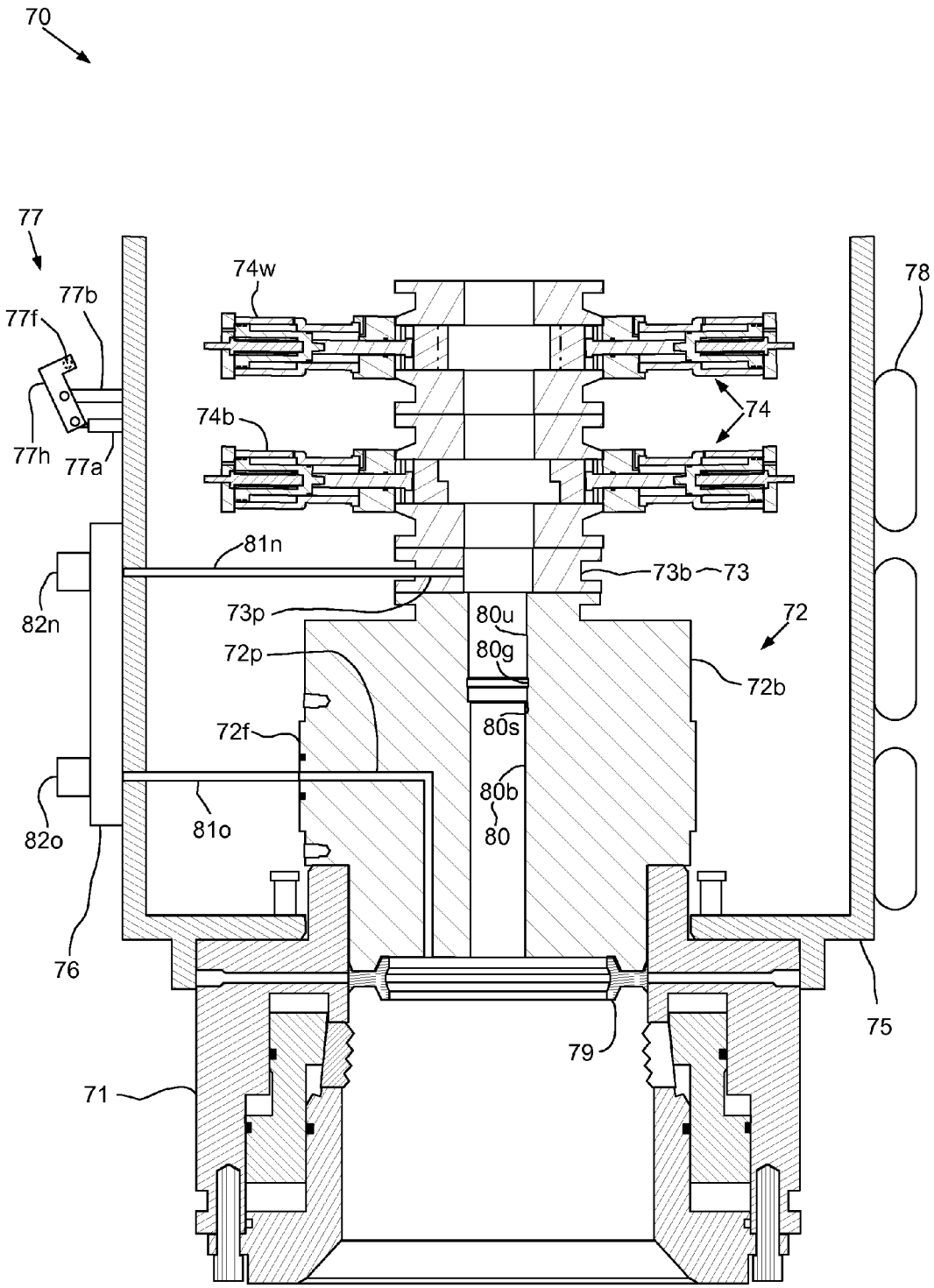
FIG. 4A illustrates a pressure control assembly (PCA) of the annulus cementing system.

FIG. 4A illustrates a pressure control assembly (PCA) 70 of the annulus cementing system. The PCA 70 may include a wellhead connector 71, a wellhead adapter 72, a fluid sub 73, a BOP stack 74, a frame 75, a manifold 76, a termination receptacle 77, one or more (three shown) accumulators 78, a face seal 79 and a subsea control system.

The wellhead connector 71 may include a fastener, such as dogs, for fastening the PCA 70 to an external profile of the subsea wellhead 10. The wellhead connector 71 may further include an electric or hydraulic actuator and an interface, such as a hot stab, so that the ROV 20 may operate the actuator for engaging the dogs with the external profile. The frame 75 may be connected to the wellhead connector 71, such as by fasteners (not shown). The manifold 76 may be fastened to the frame 75.

Figure 5A:
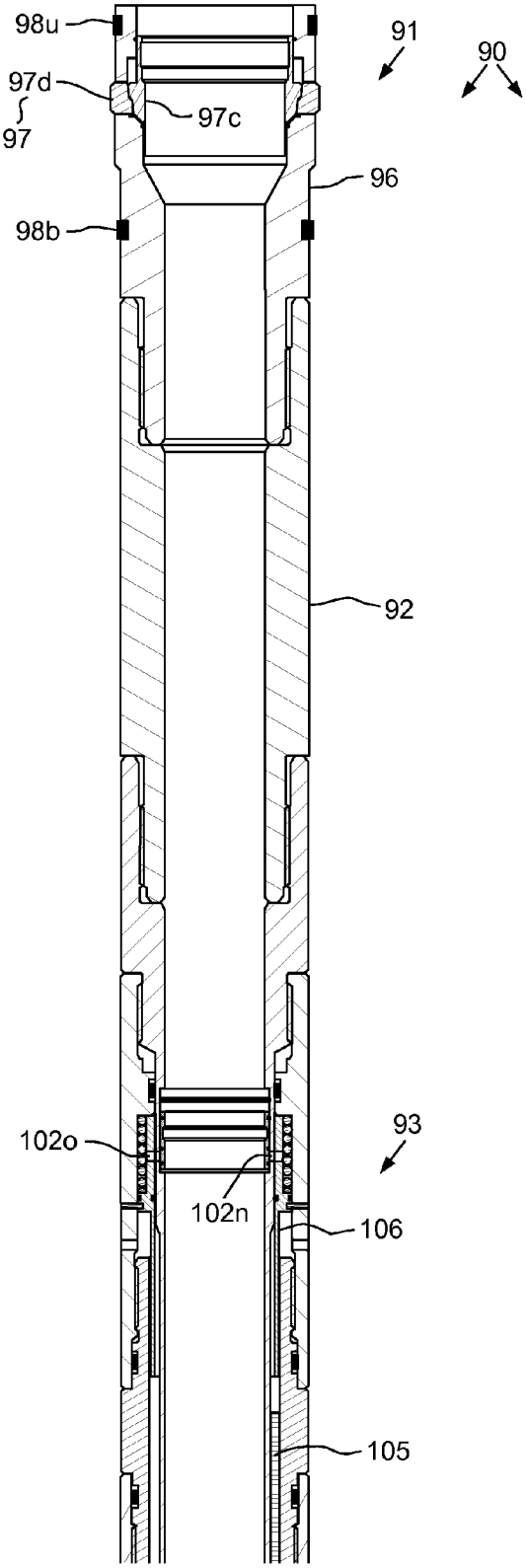
FIGS. 5A and 5B illustrate an upper annulus cementing tool of the annulus cementing system.
Figure 5B:
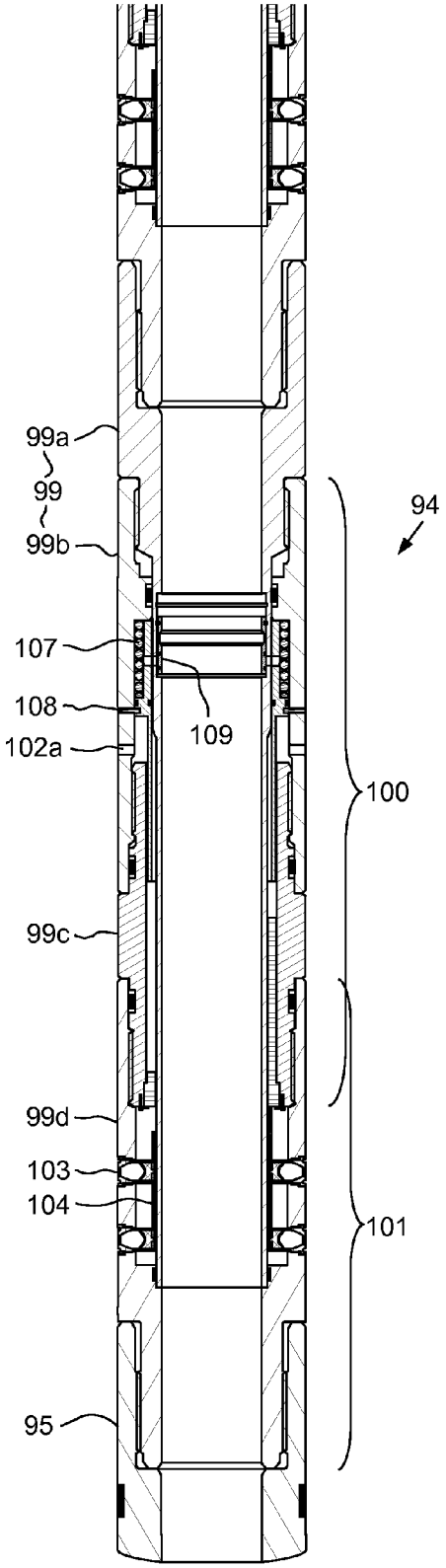

The wellhead adapter 72, fluid sub 73, and BOP stack 74 may each include a body 72*b*, 73*b* having a longitudinal bore therethrough and be connected, such as by flanges, such that a continuous bore is maintained therethrough. The bore may be sized to accommodate an upper annulus cementing tool 90 (FIGS. 5A and 5B). The adapter body 72*b* may have couplings at each longitudinal end thereof. The upper coupling may be a flange for connection to the fluid sub 73 and the lower coupling may be threaded for connection to the wellhead connector 71. The adapter body 72*b* may also have a seal face formed in a bottom thereof for receiving the face seal 79, may have another seal face 72*f* formed in a side thereof, and a flow passage 72*p* formed in a wall thereof. The adapter body 72*b* may further include a landing profile 80 formed in an inner surface thereof for receiving a hanger 91 (FIG. 5A) of the upper annulus cementing tool 90. The landing profile 80 may include a landing shoulder 80*s* a latch profile, such as a groove 80*g*, and one or more seal bores, such as upper seal bore 80*u* and lower seal bore 80*b*.

The flow passage 72*p* may provide fluid communication between the seal face 72*f* and the subsea wellhead 10. A fluid conduit 810 may connect to the seal face 72*f* and the manifold 76 and provide fluid communication between the flow passage 79 and an outlet coupling 820 of an outlet dry break connection 830 (FIG. 4C). The fluid sub 73 may include a port 73*p* formed through the body 73*b* thereof and communication with the bore. Another fluid conduit 81*n* may connect to the fluid sub 73 and the manifold 76 and provide fluid communication between the fluid sub port 73*p* and an inlet coupling 82*n* of an inlet dry break connection 83*n* (FIG. 4C).

The BOP stack 74 may include one or more hydraulically operated ram preventers, such as a blind-shear preventer 74*b* and a wireline preventer 74*w*, connected together via bolted flanges. Each ram preventer 74*b,w* may include two opposed rams disposed within each body thereof. Opposed cavities may intersect the body bore and support the rams as they move radially into and out of the bore. A bonnet may be connected to the respective body on the outer end of each cavity and may support an actuator that provides the force required to move the rams into and out of the bore. Each actuator may include a hydraulic piston to radially move each ram and a mechanical lock to maintain the position of the ram in case of hydraulic pressure loss. The lock may include a threaded rod, a motor (not shown) for rotationally driving the rod, and a threaded sleeve. Once each ram is hydraulically extended into the bore, the motor may be operated to push the sleeve into engagement with the piston. Each actuator may include single or dual pistons. The blind-shear preventer 74*b* may cut the wireline 29 when actuated and seal the body bore. The wireline preventer 74*w* may seal against an outer surface of wireline 29 when actuated.

The termination receptacle 77 may be operable to receive a termination head 84*h* (FIG. 4C) of a subsea control line 84*u*. The termination receptacle 77 may include a base 77*b*, a latch 77*h*, and an actuator 77*a*. The receptacle base 77*b* may be connected to the frame 75, such as by fasteners, and may include a landing plate for supporting the termination head 84*h*, a landing guide (not shown), such as a pin, and a stab plate. The receptacle stab plate and termination head 84*h*, when connected (termination assembly), may provide communication, such as electric (power and/or data), hydraulic, and/or optic, between the subsea control line 84*u* (FIG. 4C) and the subsea control system. The subsea control system may be mounted on the PCA 70 or a subsea skid or may be integrated with the termination head 84*h*. The receptacle latch 77*h* may be pivoted to the base 77*b*, such as by a fastener, and be movable by the actuator 77*a* between an engaged position (FIG. 4C) and a disengaged position (shown). The receptacle actuator 77*a* may be a piston and cylinder assembly connected to the frame 75 and the receptacle 77 may further include an interface (not shown), such as a hot stab, so that the ROV 20 may operate the receptacle actuator. The receptacle actuator 77*a* may also be in communication with the stab plate for operation via the subsea control line 84*u*. The receptacle latch 77*h* may include outer members and a crossbar (not shown) connected to each of the outer members by a shearable fastener 77*f*. The receptacle actuator 77*a* may be dual function so that the latch may be locked in either of the positions by either the ROV 20 or the control line.

Figure 4B:
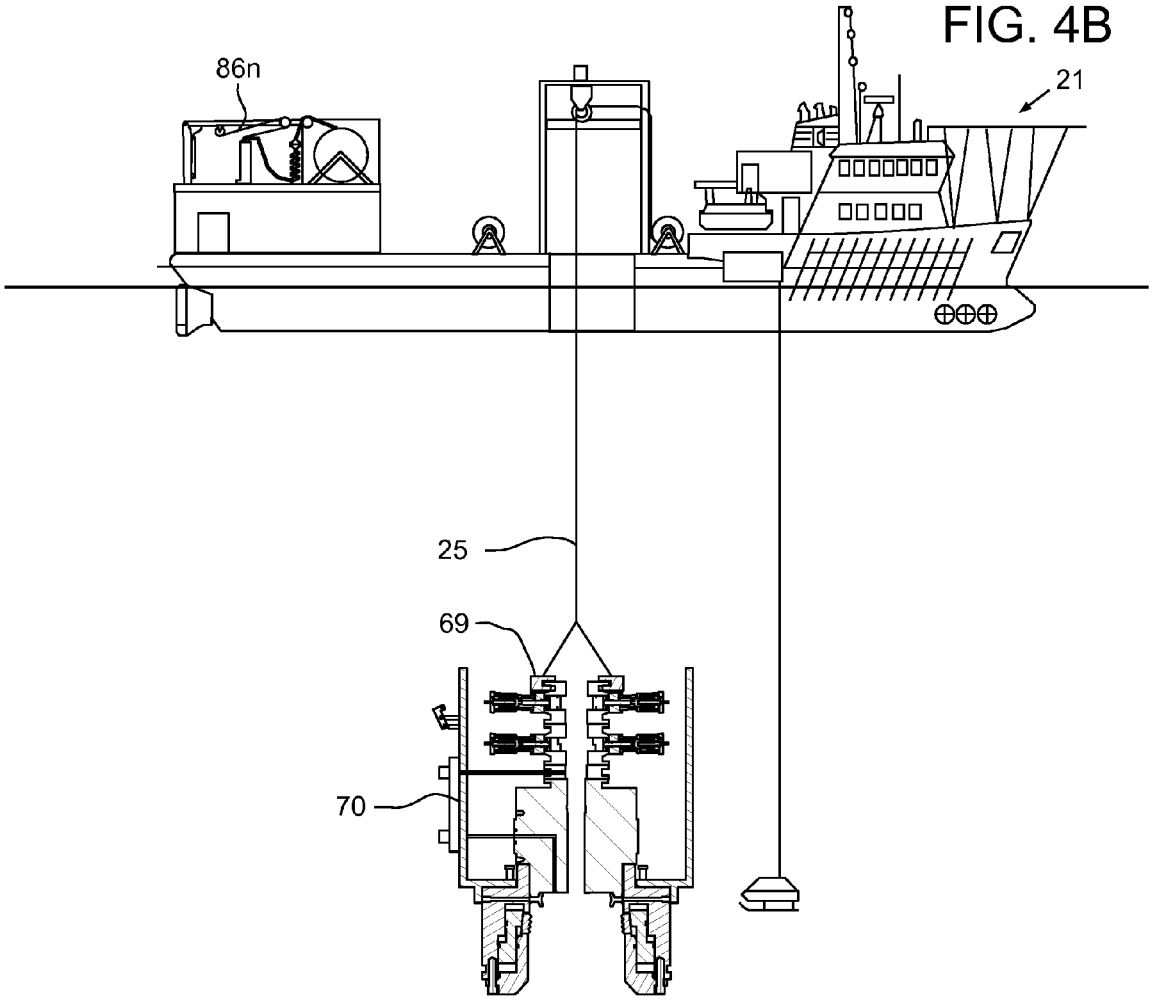
FIG. 4B illustrates deployment of the PCA.
Figure 4B:
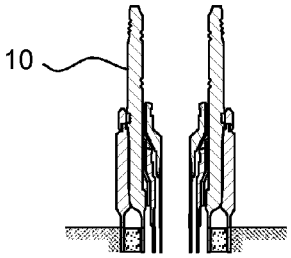
Figure 4C:
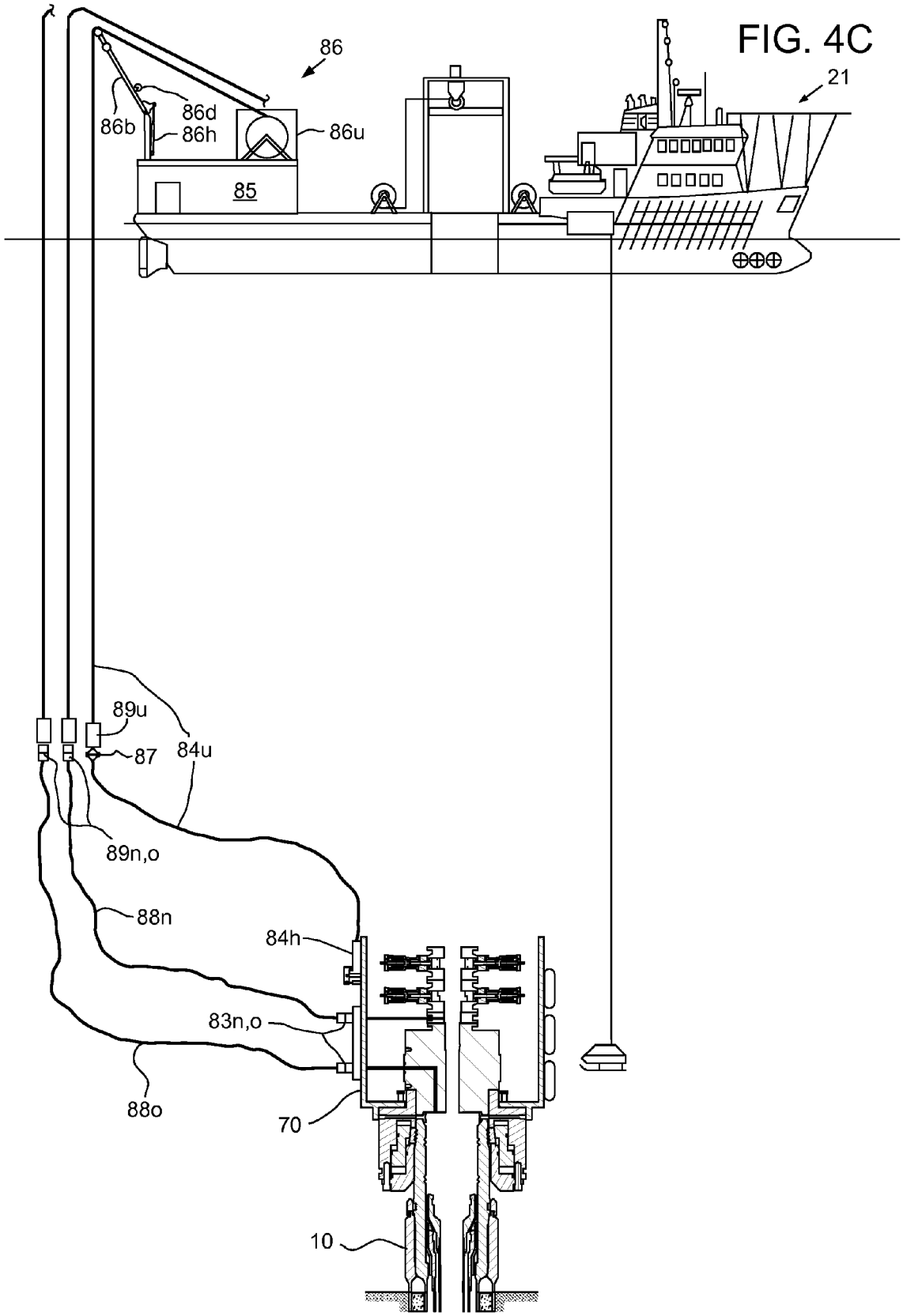
FIG. 4C illustrates installation of the PCA onto the subsea wellhead and connection of the PCA to the support vessel.

FIG. 4B illustrates deployment of the PCA 70. Once the packer 37 has been set, a grapple 69 may be connected to the wire rope 25 and engaged with the PCA 70. The wire rope 25 may then be used to lower the PCA 70 to the subsea wellhead 10 through the moonpool 23 of the vessel 21. The ROV 20 may guide landing of the PCA 70 onto the wellhead 10. The ROV 20 may then operate the wellhead connector 71 to fasten the PCA 70 to the subsea wellhead 10. The ROV 20 may then operate the grapple to release the PCA 70.

FIG. 4C illustrates installation of the PCA 70 onto the subsea wellhead 10 and connection of the PCA to the support vessel 21. The subsea control system may be in electric, hydraulic, and/or optic communication with a surface control system of a control van 85 onboard a support vessel 21 via the subsea control line 84*u*, such as an umbilical. The subsea control system may further include a control pod having one or more control valves (not shown) in communication with the BOP stack 74 (via the stab plate) for selectively providing fluid communication with the accumulators 78 for operation of the BOP stack. Each pod control valve may include an electric or hydraulic actuator in communication with the control line 84*u*. The accumulators 78 may store pressurized hydraulic fluid for operating the BOP stack 74. Additionally, the accumulators 78 may be used for operating one or more of the other components of the PCA 70. The accumulators 78 may be charged via a conduit of the control line 84*u* or by the ROV 20.

Alternatively, the subsea control line 84*u* may be a hydraulic flying lead or an electrical cable.

The subsea control system may further include a PLC, a modem, a transceiver, and a power supply. The power supply may receive an electric power signal from a power cable of the control line 84*u* and convert the power signal to usable voltage for powering the subsea control system components as well as any of the PCA components. The PCA 20 may further include one or more pressure sensors (not shown) in communication with the PCA bore at various locations. The modem and transceiver may be used to communicate with the control van 85 via the control line 84*u*. The power cable may be used for data communication or the control line 84*u* may further include a separate data cable (electric or optic). The control van 85 may include a control panel (not shown) so that the various functions of the PCA 20 may be operated by an operator on the vessel 21.

The vessel 21 may further include a launch and recovery system (LARS) 86 for deployment of the termination head 84*h* and the control line 84*u*. The LARS 86 may include a frame, a control winch 86*u*, a boom 86*b*, a boom hoist 86*h*, a load winch 86*d*, and an HPU (not shown). The LARS 86 may be the A-frame type (shown) or the crane type (not shown). For the A-frame type LARS 86, the boom 86*b* may be an A-frame pivoted to the frame and the boom hoist 86*h* may include a pair of piston and cylinder assemblies, each piston and cylinder assembly pivoted to each beam of the boom and a respective column of the frame.

The control line 84*u* may include an upper portion and a lower portion fastened together by a shearable connection 87. Each winch 86*d,u* may include a drum having the respective control line 84*u* or load line 86*n* (FIG. 4B) wrapped therearound and a motor for rotating the drum to wind and unwind the control line portion or load line. The load line 86*n* may be wire rope. Each winch motor may be electric or hydraulic. A control sheave and a load sheave may each hang from the boom 86*b*. The control line upper portion may extend through the control sheave and an end of the control line upper portion may be fastened to the shearable connection 87. The LARS 86 may have a platform for the termination head 84*h* to rest. The control line lower portion may be coiled and have a first end fastened to the shearable connection 87 and a second end fastened to the termination head 84*h*. The load line 86*n* may extend through the load sheave and have an end fastened to the lifting lugs of the termination head 84*h*, such as via a sling. Pivoting of the A-frame boom 86*b* relative to the platform by the piston and cylinder assemblies may lift the termination head 84*h* from the platform, over a rail of the vessel 21, and to a position over the waterline 1*w*. The load winch 86*d* may then be operated to lower the control line 84*u* and termination head 84*h* into the seal.

As the load winch 86*d* lowers the termination head 60, the control line lower portion may uncoil and be deployed into the sea 1 until the shearable connection 87 is reached. Once the shearable connection 87 is reached, a clump weight 89*u* may be fastened to a lower end of the control line upper portion. The termination head 84*h* may continue to be lowered using the load winch 86*d* until the shearable connection 87 and clump weight 89*u* are deployed from the LARS platform to over the waterline 1*w*. The control winch 86*u* may then be operated to support the termination head 84*h* using the control line 84*u* and the load line 86*n* slacked. The load line 86*n* and sling may be disconnected from the termination head 84*h* by the ROV 20. The termination head 84*h* may then be lowered to a landing depth using the control winch 86*u*.

As the control line 84*u* is being lowered to the landing depth, the ROV 20 may grasp the termination head 84*h* and assist in landing the termination head in the termination receptacle 77. Once landed, the ROV 20 may operate the actuator 77*a* to engage the receptacle latch 77*h* with the termination head 84*h*.

An upper portion of each fluid conduit 88*n,o* may be coiled tubing. The vessel 21 may further include a coiled tubing unit (CTU, not shown) for each fluid conduit 88*n,o*. Each CTU may include a drum having the coiled tubing wrapped therearound, a gooseneck, and an injector head for driving the coiled tubing, controls, and an HPU. A lower portion of each fluid conduit 88*n,o* may include a hose. The hose may be made from a flexible polymer material, such as a thermoplastic or elastomer or may be a metal or alloy bellows. An upper end of each hose may be connected to the respective coiled tubing by a dry beak connection 89*n,o* and a lower end of each hose may have a male coupling of the respective dry-break connection 83*n,o* connected thereto. During deployment of each fluid conduit 88*n,o*, a clump weight 89*n,o* may be fastened to the lower end of the respective coiled tubing.

FIGS. 5A and 5B illustrate the upper annulus cementing tool 90 of the annulus cementing system. The upper annulus cementing tool 90 may include a hanger 91, an extender 92, one or more of perforators, such as perforating guns 93, 94, and a stinger 95. The perforating guns 93, 94 may be disposed between the extender 92 and the stinger 95.

The hanger 91 may include a housing 96, a latch 97, and one or more stab seals 98*u,b*. The housing 96 may be tubular and have a flow bore formed therethrough. A coupling, such as a threaded box (not shown) or pin (shown), may be formed at a lower end of the housing 96 for connection with the extender 92. The housing 96 may have seal grooves formed in an outer surface thereof straddling the latch 97 and the stab seals 98*u,b* may be disposed in the respective seal grooves. Each stab seal 98*u,b* may be made from an elastomer or elastomeric copolymer and be operable to engage a respective seal bore 80*u,b*.

The latch 97 may be connected to the housing 96 at an upper end of the housing. The latch 97 may include an actuator, such as a cam 97*c*, and one or more fasteners, such as dogs 97*d*. The housing 96 may have a plurality of windows formed through a wall thereof for extension and retraction of the dogs 97*d*. The dogs 97*d* may be pushed outward by the cam 97*c* to engage the latch groove 80*g*, thereby longitudinally connecting the hanger 91 to the adapter 72. The cam 97*c* may be longitudinally movable relative to the housing 96 between an engaged position (shown) and a disengaged position (not shown). In the engaged position, the cam 97*c* may lock the dogs 97*d* in the extended position and in the disengaged position, the cam may be clear of the dogs, thereby freeing dogs to retract. The cam 97*c* may have an actuation profile formed in an outer surface thereof for pushing the dogs to the extended position, a latch profile formed in an inner surface thereof for engagement with a running tool 111 (FIG. 5C), and a seal sleeve for maintaining engagement of the cam with a seal of the latch 97 regardless of the cam position. The cam 97*c* may also maintain engagement with another seal of the latch 97 regardless of the cam position. The latch 97 may further include an upper pickup shoulder formed in an inner surface of the housing 96 and engaged with the cam 97*c* when the cam is in the disengaged position and a lower landing shoulder formed in an outer surface of the housing 96 for seating against the landing shoulder 80*s*. The pickup shoulder may be used for supporting the upper annulus cementing tool 90 when carried by the running tool 111.

Alternatively, the latch 97 may be omitted from the hanger 91.

Each perforating gun 93, 94 may include a housing 99, an igniter 100, and a charge carrier 101. Each housing 99 may be tubular and have a flow bore formed therethrough. Each housing 99 may include two or more sections 99*a-d* connected together, such as by threaded couplings. Each housing 99 may also have a coupling, such as a threaded pin or box, formed at each longitudinal end thereof for connection with the extender 92 or other perforating gun 93 at the upper end and for connection with the stinger 95 or other perforating gun 94 at the lower end. Each housing 99 may also have one or more (two shown) annulus ports 102*a* formed through a wall of section 99*b*. Each perforating gun 93, 94 may further include various seals disposed between various interfaces thereof such that a bore thereof is isolated from an exterior thereof.

Each charge carrier 101 may include a sleeve portion of housing section 99*a*, housing section 99*d*, one or more (four shown) shaped charges 103 and one or more detonation cords 104. The shaped charges 103 may be arranged in one or more (two shown) sets, each set having a plurality of shaped charges circumferentially spaced around the housing section 99*d*. Each igniter 100 may include the housing sections 99*a-c*, a blasting cap 105, a firing piston 106, a spring 107, one or more (two shown) shearable fasteners 108, and an isolation sleeve 109.

A chamber may be formed between the housing sections 99*a-c* and the blasting cap 105. The firing piston 106 and spring 107 may be disposed in the chamber. The firing piston 106 may have a shoulder carrying an outer seal engaged with an inner surface of the housing section 99*b* and the piston may carry an inner seal engaged with an outer surface of the housing section 99*a*, thereby isolating an upper portion of the chamber from a lower portion of the chamber. The spring 107 may have an upper end bearing against the housing section 99*b* and a lower end bearing against the piston shoulder, thereby biasing the firing piston 106 toward a firing position (FIGS. 6F and 7F). The firing piston 106 may be releasably restrained in a cocked position (shown) by the shearable fasteners 108 inserted into respective sockets formed through a wall of the housing section 99*b* and received by respective indentations formed in an outer surface of the piston shoulder, thereby releasably connecting the firing piston 106 and the housing 99.

Each of the firing piston 106 and housing section 99*a* may have one or more (pair shown) respective bore ports 102*n,o* formed through respective walls thereof. The bore ports 102*n,o* may initially be closed by the isolation sleeve 109. The isolation sleeve 109 may carry a pair of seals straddling the housing bore ports 102*n* and a detent engaged with a detent groove formed in an inner surface of the housing section 99*a*. The isolation sleeve 109 may have a latch profile formed in an inner surface thereof for engagement with a shifting tool 119 (FIGS. 6E and 7E). The shifting tool 119 may be used to move the isolation tool from a disarmed position (shown) to an armed position (FIGS. 6E and 7E), thereby exposing the bore ports 102*n,o* to the housing bore. The housing section 99*a* may have a second detent groove formed in an inner surface thereof for receiving the isolation sleeve detent in the armed position.

In operation, the shearable fasteners 108 may have a strength sufficient to resist the biasing force of the cocked spring 107. Once the isolation sleeve has been moved to the armed position, the bore pressure may be increased relative to the annulus pressure until a firing pressure differential is achieved. Once the bore pressure has been increased to the firing pressure differential, the firing piston 106 may break the fasteners 108 and the spring 107 may snap the firing piston downward to strike the blasting cap 105. The blasting cap 105 may then ignite the detonation cords 104 which may fire the shaped charges 103.

The stinger 95 may include a body and a stab seal disposed in a seal groove formed in an outer surface of the body. The stinger body may have a guide nose to facilitate stabbing into the PBR 36.

Figure 5C:
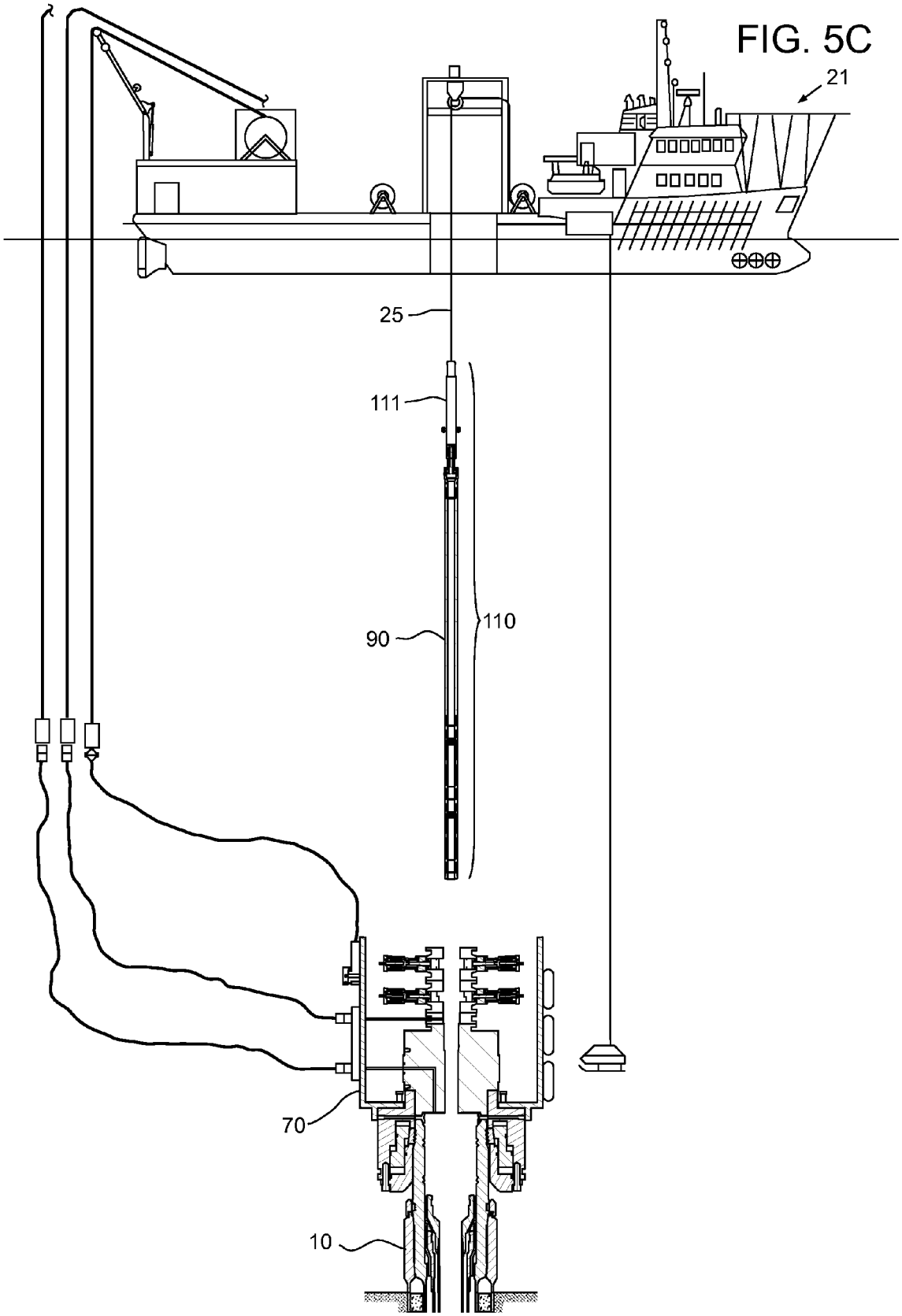
FIG. 5C illustrates deployment of the upper annulus cementing tool.
Figure 5D:
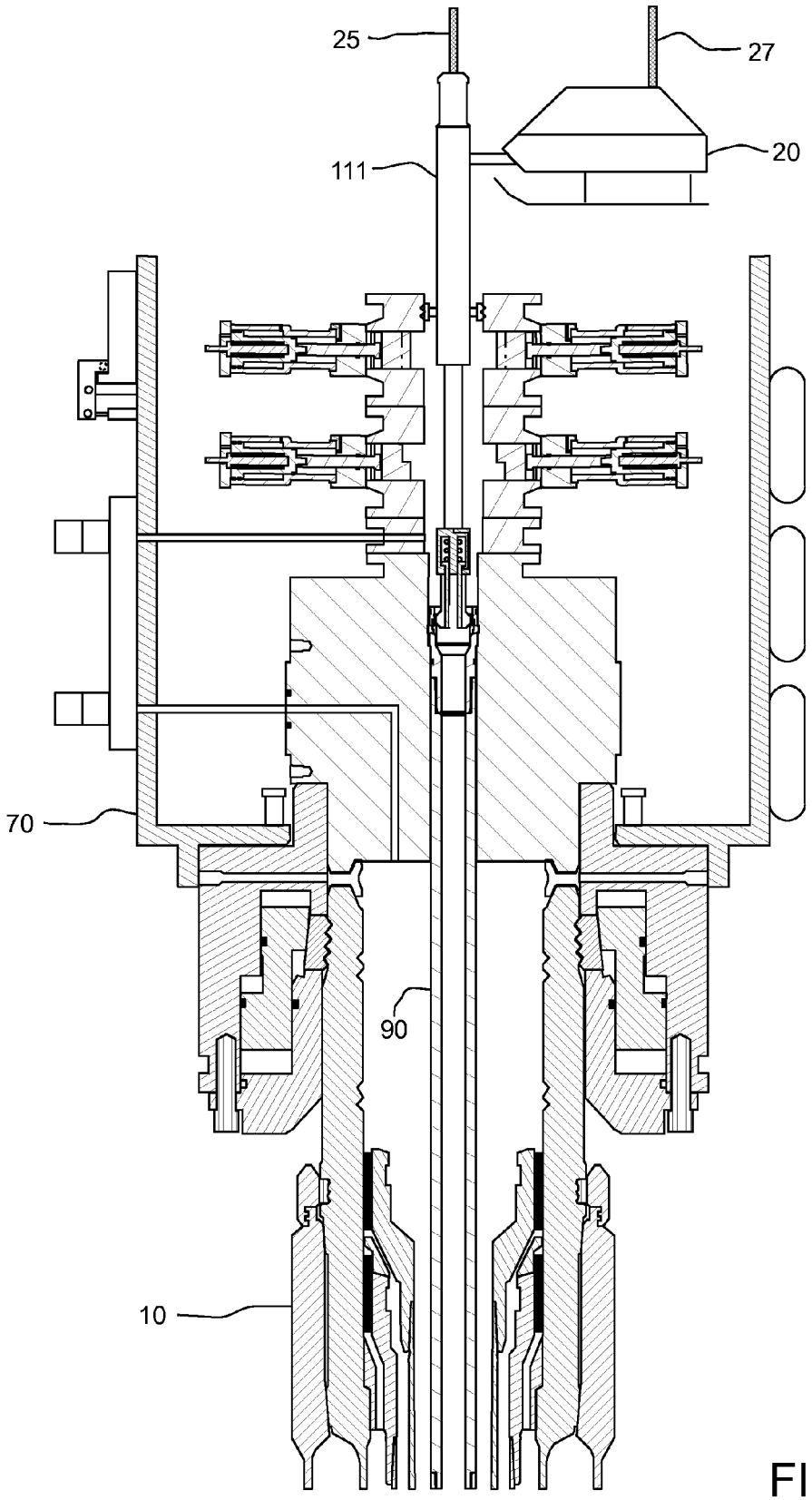
FIG. 5D illustrates hanging of the upper annulus cementing tool from the PCA.
Figure 5E:
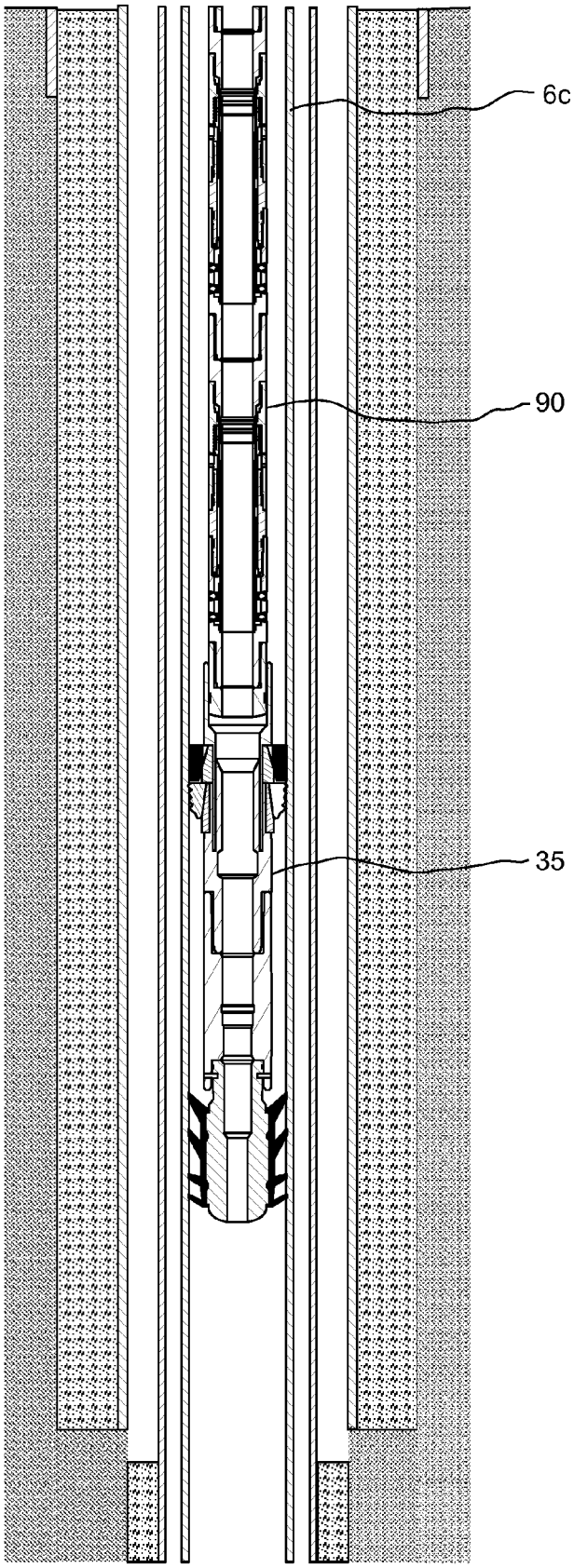
FIG. 5E illustrates stabbing of the upper annulus cementing tool into the lower annulus cementing tool.

FIG. 5C illustrates deployment of the upper annulus cementing tool 90. FIG. 5D illustrates hanging of the upper annulus cementing tool 90 from the PCA 70. FIG. 5E illustrates stabbing of the upper annulus cementing tool 90 into the lower annulus cementing tool 35. Once the PCA 70 has been installed onto the subsea wellhead 10 and connected to the support vessel 21, a sixth BHA 110 may be connected to the wire rope 25 and deployed through the open sea 1 to the PCA 70. The sixth BHA 110 may include a cablehead, a collar locator, a running tool 111, and the upper annulus cementing tool 90.

The running tool 111 may be tubular and include a stroker, an ROV interface, a cablehead, an anchor, and a latch. The stroker, ROV interface, cablehead, and anchor, may each include a housing connected, such as by threaded connections. The stroker may include the housing and a shaft. The ROV interface may include one or more hot stabs for operating the stroker, the anchor, and the latch. The cablehead may connect the running tool 111 to the wire rope 25. The anchor may include two or more radial piston and cylinder assemblies and a die connected to each piston or two or more slips operated by a slip piston. The stroker, anchor, and latch of the running tool 111 may be similar to those of the setting tool 65.

The ROV 20 may be used to guide the stinger 95 into the PCA 70. The winch 24 may be operated to lower the upper annulus cementing tool 90 through the PCA 70 until the hanger 91 is adjacent to the landing profile 80 and the stinger 95 is adjacent to the PBR 36. The ROV 20 may then connect to the running tool 111 via hot stab and supply hydraulic fluid to operate the anchor and stroker thereof, thereby setting the hanger 91 into the into the landing profile 80 and stabbing the stinger 95 into the PBR 36. The ROV 20 may then operate the setting tool 111 to release the hanger 91, retract the stroker, and release the anchor. The ROV 20 may disconnect from the running tool 111 and the sixth BHA 110 (minus the upper annulus cementing tool 90) may be retrieved to the vessel 21.

Figure 5F:
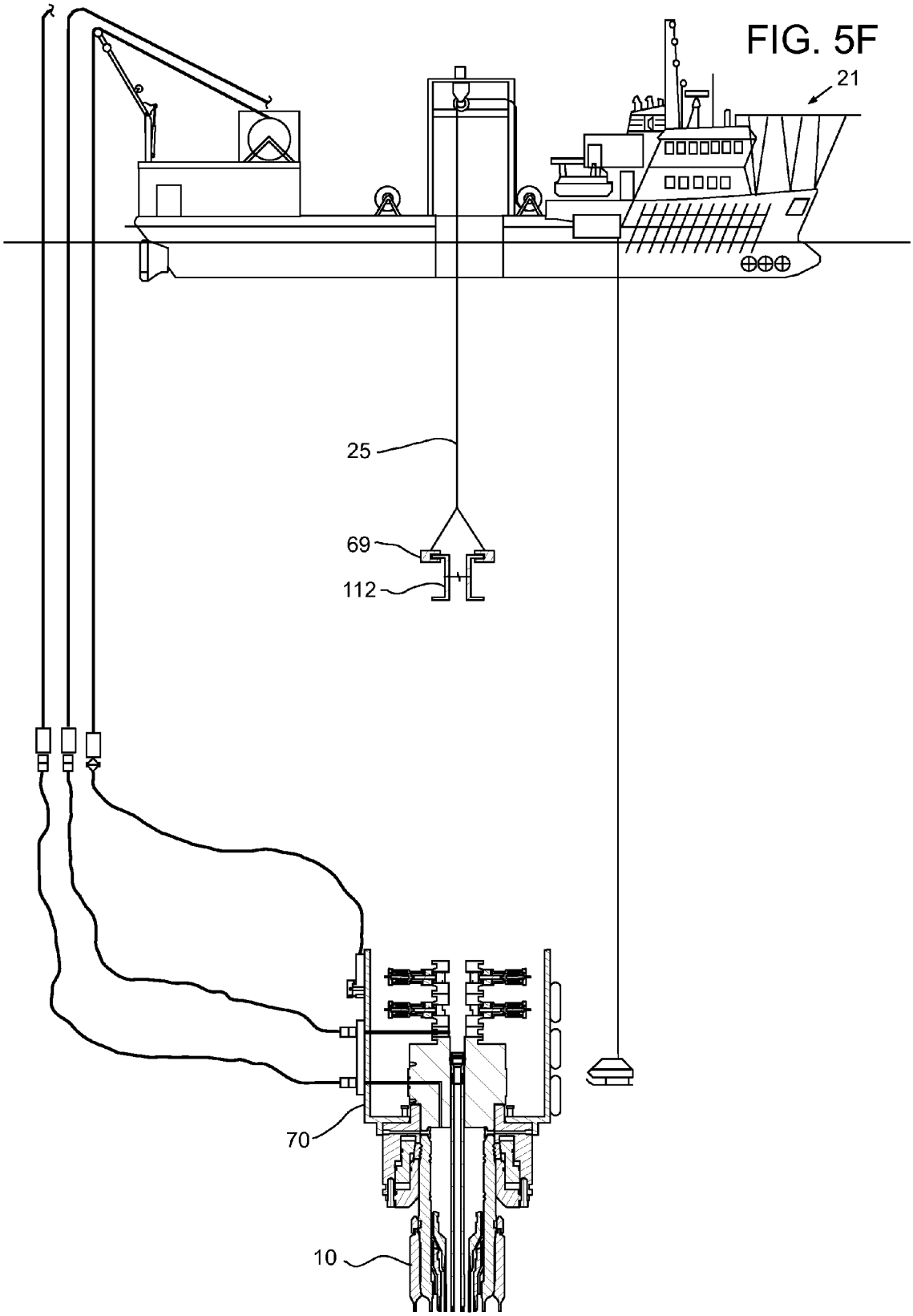
FIG. 5F illustrates deployment of a tool housing to the PCA.

FIG. 5F illustrates deployment of a tool housing 112 to the PCA 70. Once the upper annulus cementing tool 90 has been set, the grapple 69 may be connected to the wire rope 25 and engaged with tool housing 112. The wire rope 25 may then be used to lower the tool housing 112 to the subsea wellhead 10 through the moonpool 23 of the vessel 21. The ROV 20 may guide landing of the tool housing 112 onto the PCA 70. The ROV 20 may then operate a PCA connector (not shown) of the tool housing 112 to fasten the tool housing to the PCA 70. The ROV 20 may then operate the grapple 69 to release the tool housing 112.

Figure 6A:
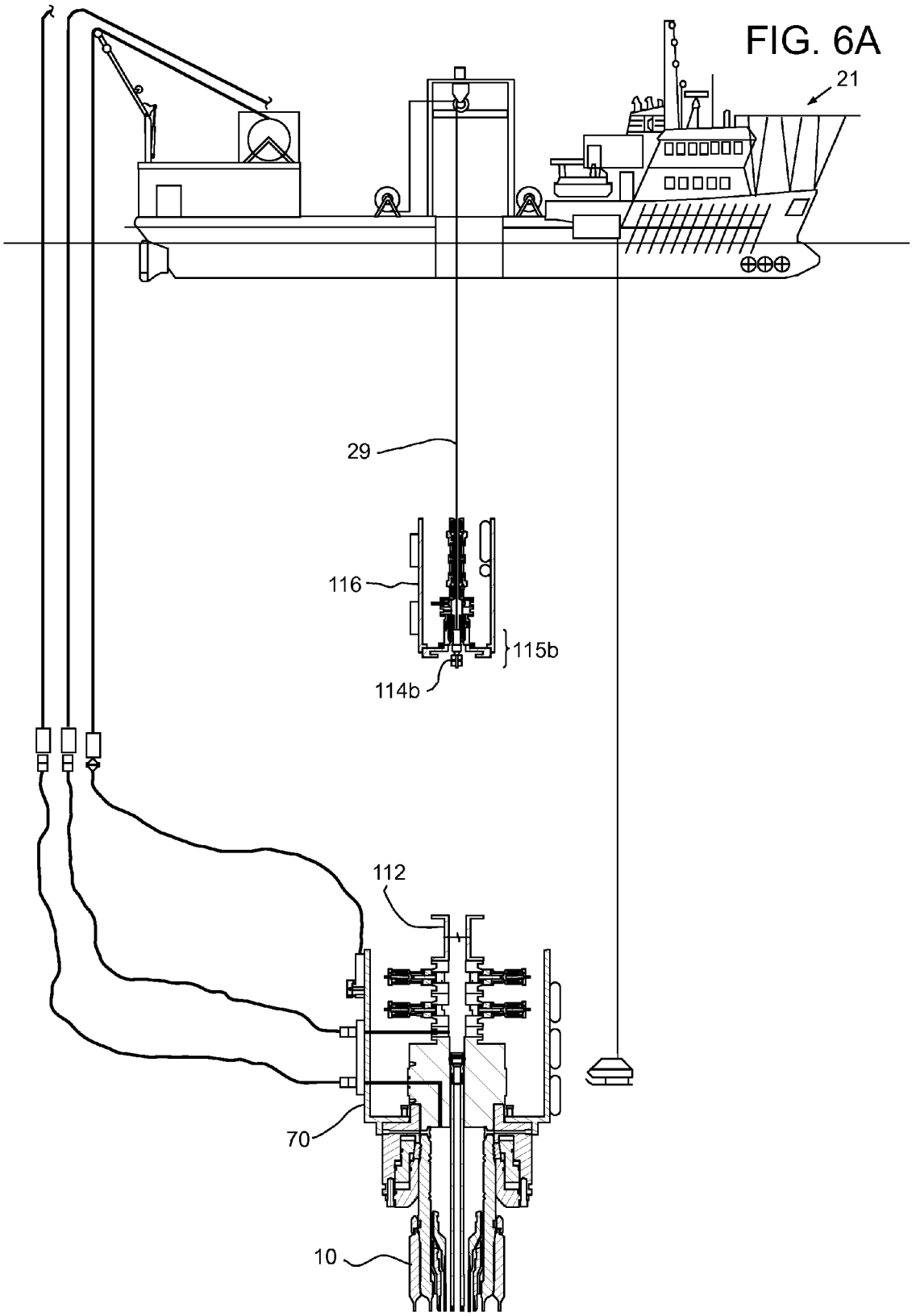
FIGS. 6A-6I illustrate cement plugging of an annulus formed between the production casing and the intermediate casing strings.
Figure 6B:
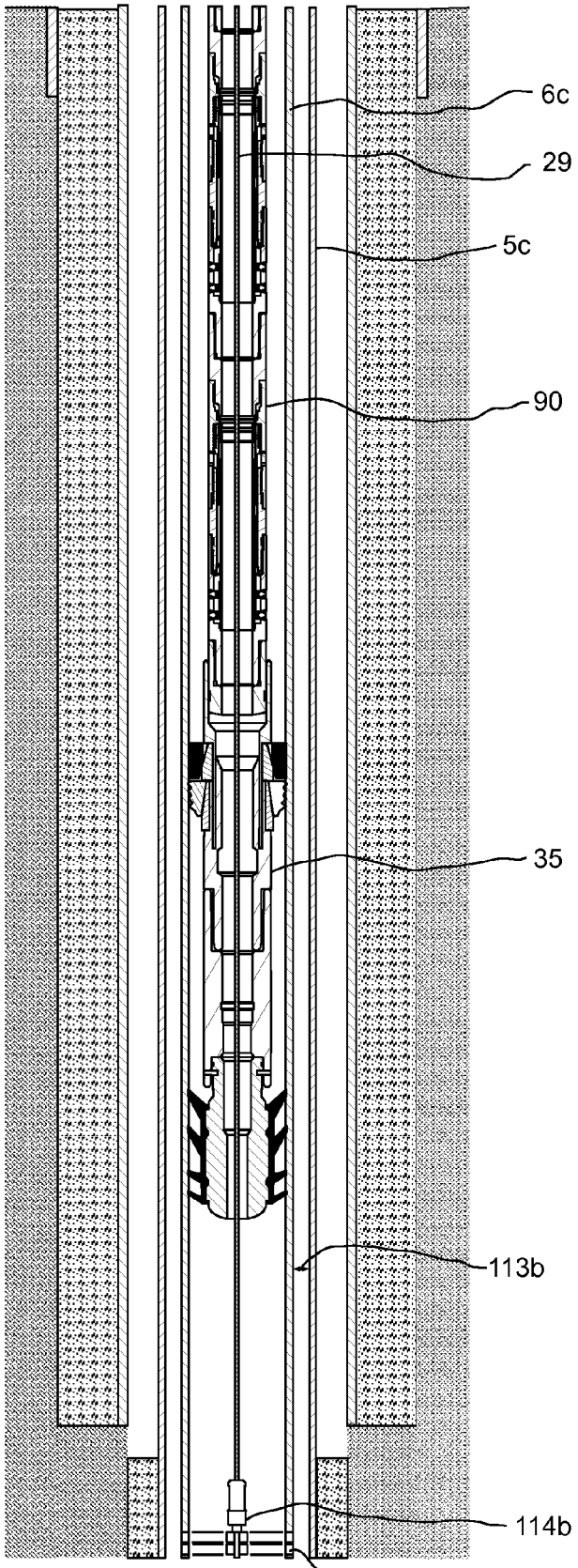
Figure 6C:
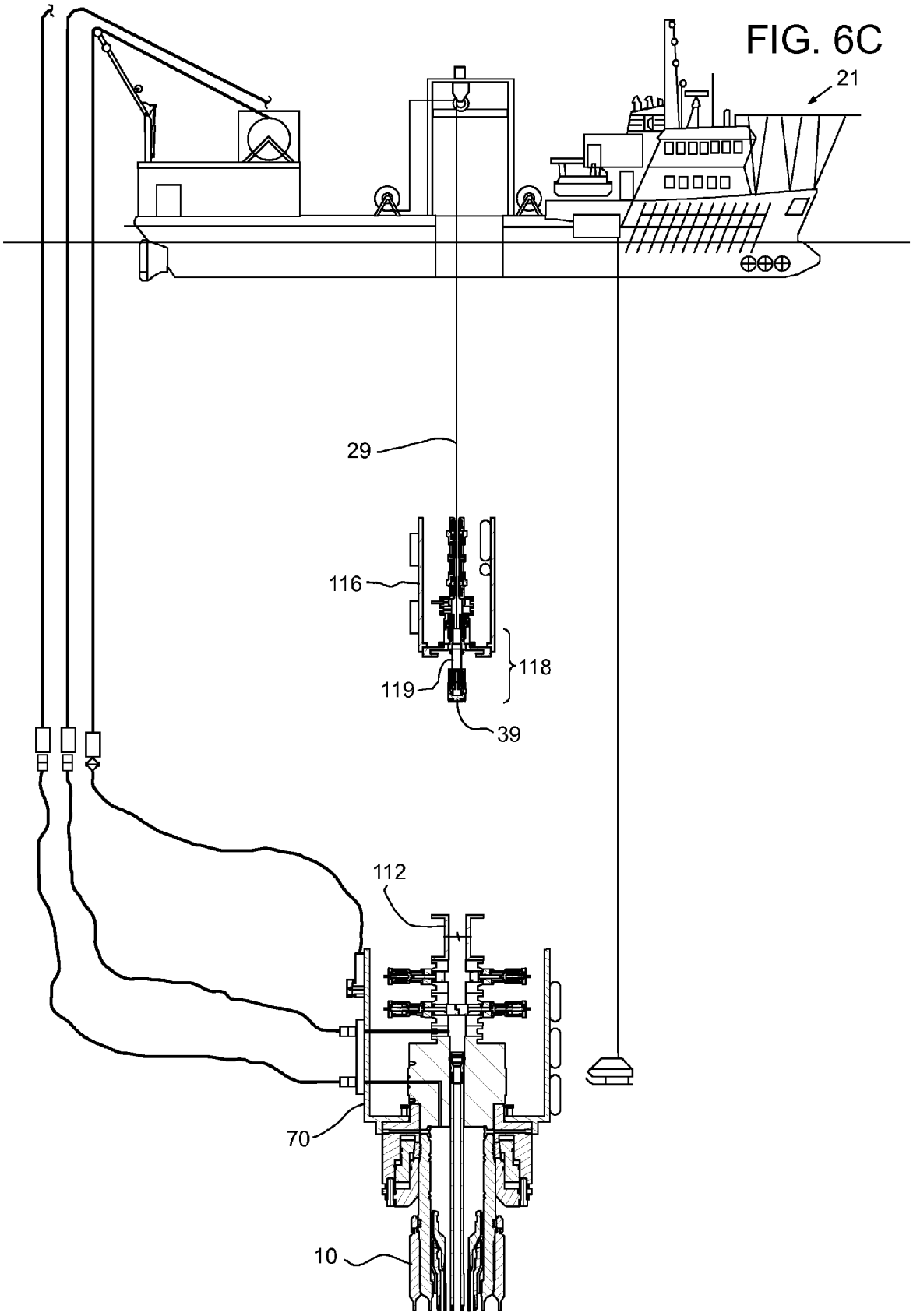
Figures 6D, 6E:
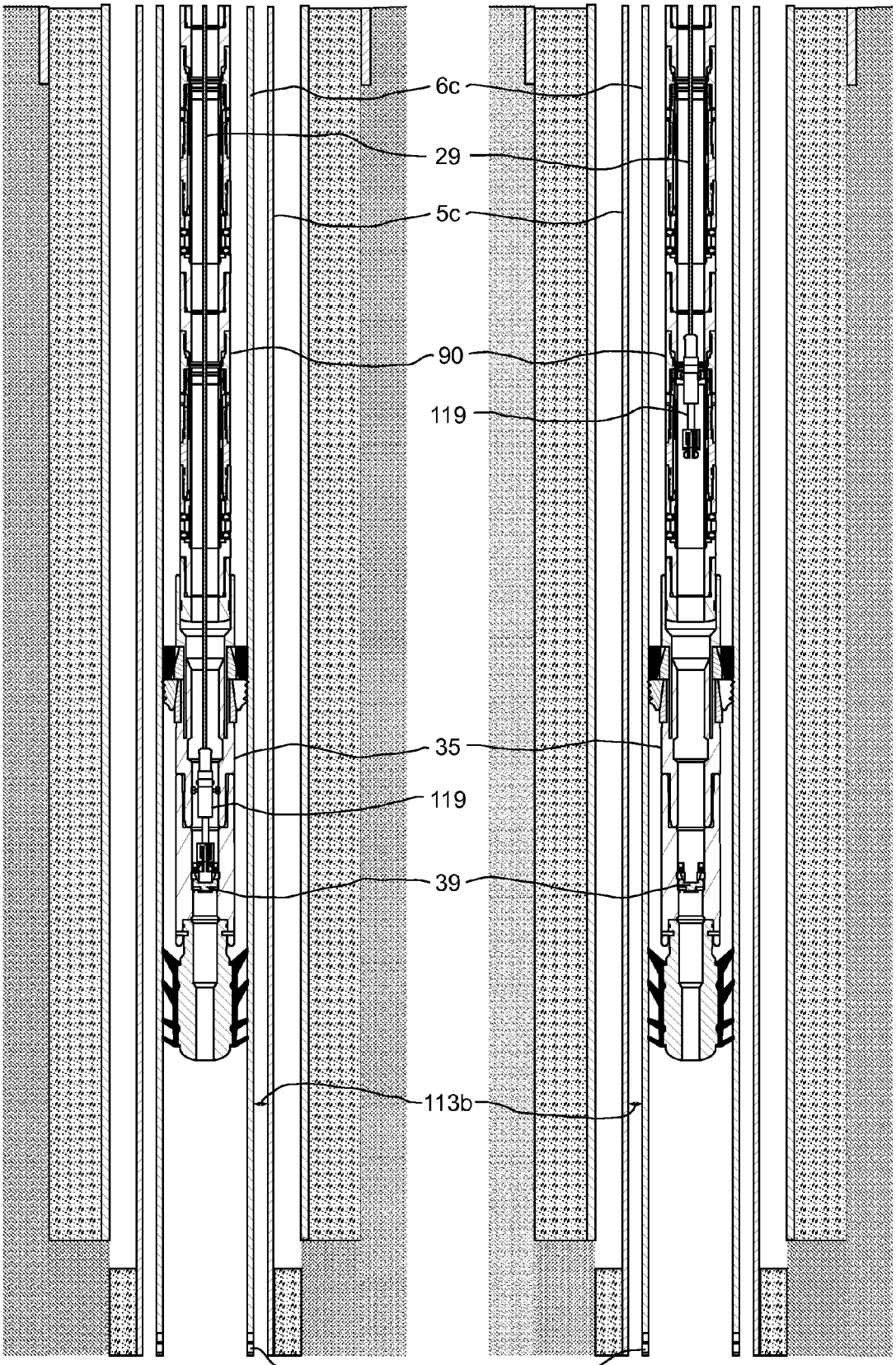
Figures 6F, 6G:
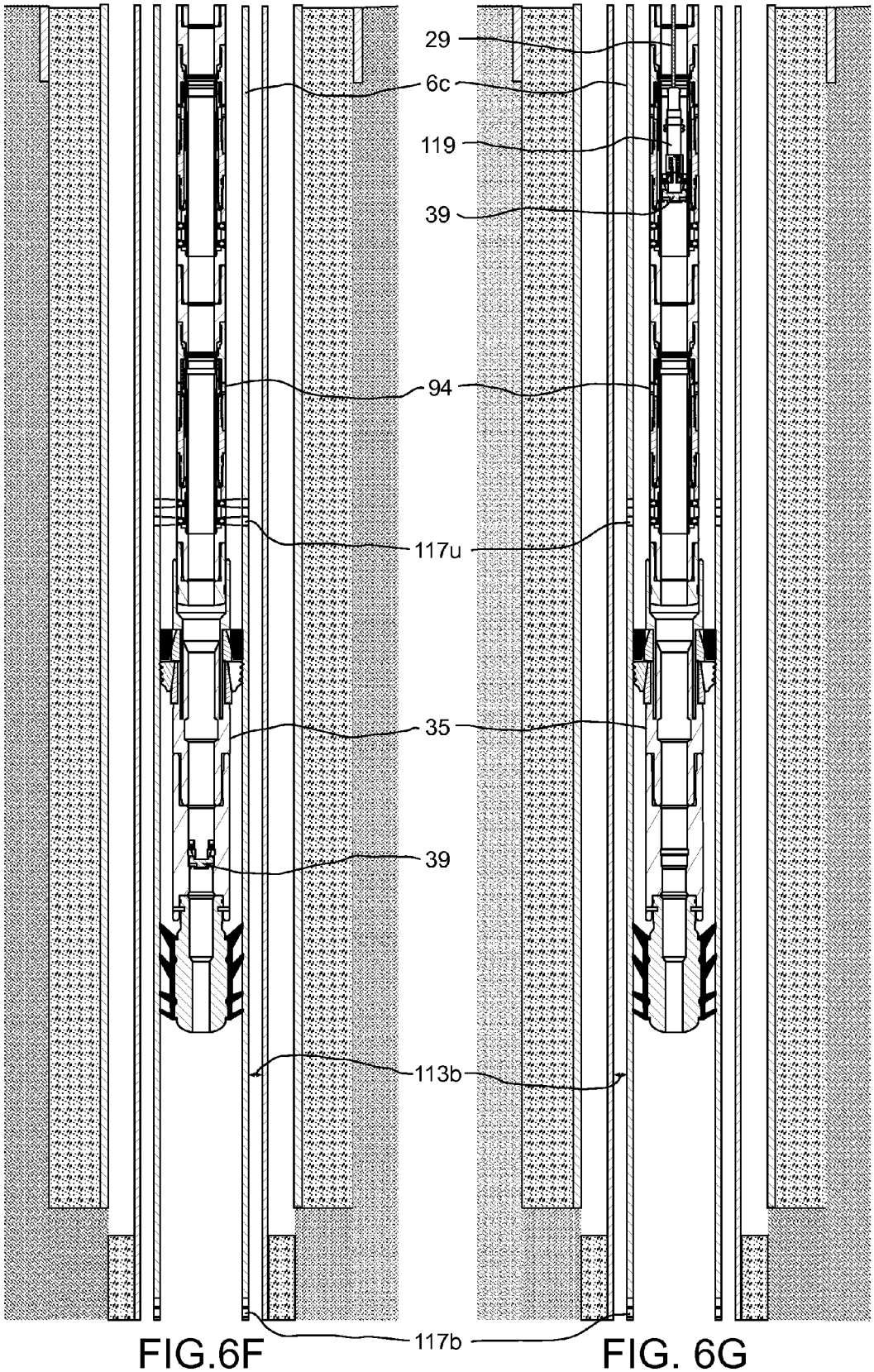

FIGS. 6A-6I illustrate cement plugging of an annulus 113*b* (aka the B annulus) formed between the production 6 and the intermediate 5 casing strings. FIG. 6A illustrates deployment of a lower perforating gun 114*b* of the annulus cementing system. Once the tool housing has been installed onto the PCA, a seventh BHA 115*b* may be assembled with a lubricator 116, connected to the wireline 29, and deployed to the PCA 70. The seventh BHA 115*b* may include a cablehead, a collar locator, and the perforating gun 114*b*. The cablehead, collar locator, and perforating gun 114*b* may be connected together, such as by threaded connections or flanges and studs or bolts and nuts. The perforating gun may include a firing head and a charge carrier. The charge carrier may include a housing, a plurality of shaped charges, and detonation cord connecting the charges to the firing head. The firing head may receive electricity from the wireline 29 to operate an electric match thereof. The electric match may ignite the detonation cord to fire the shaped charges.

The lubricator 116 may include an adapter, one or more stuffing boxes, a grease injector, a frame, a control relay, a tool catcher, a grease reservoir, and a grease pump. The adapter, stuffing boxes, grease injector, and tool catcher may each include a housing or body having a longitudinal bore therethrough and be connected, such as by flanges, such that a continuous bore is maintained therethrough.

The adapter may include a connector for mating with a connector profile of the tool housing 112, thereby fastening the lubricator 116 to the tool housing 112. The connector may be dogs or a collet. The adapter may further include a seal face or sleeve and a seal (not shown). The adapter may further include an actuator (not shown), such as a piston and a cam, for operating the connector. The adapter may further include an ROV interface so that the ROV 20 may connect to the connector, such as by a hot stab, and operate the connector actuator. The frame may be fastened to the adapter and the relay may be fastened to the frame. The grease pump and reservoir may also be fastened to the frame.

Each stuffing box may include a seal, a piston, and a spring disposed in the housing. A port may be formed through the housing in communication with the piston. The port may be connected to the control relay via a hydraulic conduit (not shown). When operated by hydraulic fluid, the piston may longitudinally compress the seal, thereby radially expanding the seal inward into engagement with the wireline 29. The spring may bias the piston away from the seal and be set to balance hydrostatic pressure.

The grease injector may include a housing integral with each stuffing box housing and one or more seal tubes. Each seal tube may have an inner diameter slightly larger than an outer diameter of the wireline 29, thereby serving as a controlled gap seal. An inlet port and an outlet port may be formed through the grease injector/stuffing box housing. A grease conduit (not shown) may connect an outlet of the grease pump with the inlet port and another grease conduit (not shown) may connect an inlet of the pump to the reservoir. The outlet port may discharge into the sea 1 or a grease trap. The grease pump may be electrically or hydraulically driven via cable/conduit (not shown) connected to the control relay and may be operable to pump grease (not shown) from the grease reservoir into the inlet port and along the slight clearance formed between the seal tube and the wireline 29 to lubricate the wireline, reduce pressure load on the stuffing box seals, and increase service life of the stuffing box seals.

The tool catcher may include a piston, a latch, such as a collet, a stop, a piston spring, and a latch spring disposed in a housing thereof. The collet may have an inner cam surface for engagement with the cablehead and the catcher housing may have an inner cam surface for operation of the collet. The latch spring may bias the collet toward a latched position. The collet may be movable from the latched position to an unlatched position by operation of the piston. The catcher housing may have a hydraulic port formed through a wall thereof in fluid communication with the piston. A hydraulic conduit (not shown) may connect the hydraulic port to the control relay. The piston may be biased away from engagement with the collet by the piston spring. When operated, the piston may engage the collet and move the collet upward along the housing cam surface and into engagement with the stop, thereby moving the collet to the unlatched position.

FIG. 6B illustrates firing of the lower perforating gun 114*b* to perforate the production casing 6*c*. Once the lubricator 116 has landed onto the PCA 70, the ROV 20 may operate the connector and install a jumper (not shown) between the lubricator control relay and the PCA 70. The stuffing boxes and grease injector may be activated and the tool catcher operated to release the seventh BHA 115*b*. The seventh BHA 115*b* may then be lowered through the annulus cementing tools 35, 90 to a depth below the cementing plug 40 and above the lower bridge plug 33*b*. Once the seventh BHA 115*b* has been deployed to the firing depth, electrical power may then be supplied to via the wireline 29 to fire the perforating gun 114*b* into the production casing 6*c*, thereby forming lower perforations 117*b* through a wall thereof. The shaped charges of the perforating gun 114*b* may have a charge strength sufficient to form the lower perforations 117*b* through a wall of the production casing 6*c* without damaging a wall of the intermediate casing 5*c*, thereby providing access to the B annulus 113*b*. The seventh BHA 115*b* may then be retrieved to the lubricator 116, the blind-shear BOP 74*b* closed, and the lubricator and seventh BHA 115*b* dispatched from the PCA 70 to the vessel 21.

FIG. 6C illustrates deployment of the bore plug 39. FIG. 6D illustrates setting of the bore plug 39 in the lower annulus cementing tool 35. FIG. 6E illustrates opening an isolation sleeve 109 of the upper annulus cementing tool 90. Once the lower perforations 117*b* have been formed, an eighth BHA 118 may be assembled with the lubricator 116 and connected to the wireline 29 and deployed through the open sea 1 to the tool housing 112. The eighth BHA 118 may include a cablehead, a collar locator, a shifting tool 119, and the bore plug 39. The shifting tool 119 may be similar to the setting tool 65 with the addition of a shifter. The shifter may include two or more radial piston and cylinder assemblies and a latch connected to each piston for engagement with the isolation sleeve 109.

Once the lubricator 116 has landed onto the PCA 70, the ROV 20 may operate the connector and install the jumper. The stuffing boxes and grease injector may be activated and then the blind-shear BOP 74*b* opened. The tool catcher may be operated to release the eighth BHA 118 and the eighth BHA 118 may then be lowered through the upper annulus cementing tool 90 and into the lower annulus cementing tool 35 to a depth adjacent the nipple 38. The shifting tool 119 may then be operated via the wireline 29 to install the bore plug 39 into the nipple profile. The shifting tool 119 may then be operated via the wireline 29 to release the bore plug 39 and the eighth BHA 118 (minus the bore plug) raised into the upper annulus cementing tool 90 until the shifter is adjacent to the isolation sleeve 109 of the perforating gun 94. The shifting tool 119 may be operated via the wireline 29 to engage the isolation sleeve 109 and shift the isolation sleeve to the armed position. The eighth BHA 118 (minus the bore plug 39) may then be retrieved to the lubricator 116 and the blind-shear BOP 74*b* closed.

FIG. 6F illustrates firing of the perforating gun 94 of the upper annulus cementing tool 90 to again perforate the production casing 6*c*. Once the perforation gun 94 has been armed, conditioner 120 (FIG. 6H) may be pumped from the vessel 21, down the supply fluid conduit 88*n*, through the conduit 81*n* and fluid sub port 73*p*, through a bore of the PCA 70, through the bore of the upper annulus cementing tool 90, and against the seated bore plug 39, thereby increasing pressure in the bores of the annulus cementing tools 35, 90 until the firing differential is achieved, thereby firing the perforating gun 94 into the production casing 6*c* and forming upper perforations 117*u* through the wall thereof. The shaped charges 103 of the perforating gun 94 may have a charge strength sufficient to form the upper perforations 117*u* through a wall of the production casing 6*c* without damaging a wall of the intermediate casing 5*c*, thereby providing further access to the B annulus 113*b*.

FIG. 6G illustrates retrieval of the bore plug 39 from the lower annulus cementing tool 35. Once the upper perforations 117*u* have been formed, the blind-shear BOP 74*b* may be opened and the eighth BHA 118 (minus the bore plug 39) may then be lowered through the upper annulus cementing tool 90 and into the lower annulus cementing tool 35 to a depth adjacent the nipple 38. The shifting tool 119 may then be operated via the wireline 29 to engage the bore plug 39 and remove the bore plug from the nipple profile. The eighth BHA 118 may then be retrieved to the lubricator 116, the blind-shear BOP 74*b* closed, and the lubricator and eighth BHA dispatched from the PCA 70 to the vessel 21.

Figures 6H, 6I:
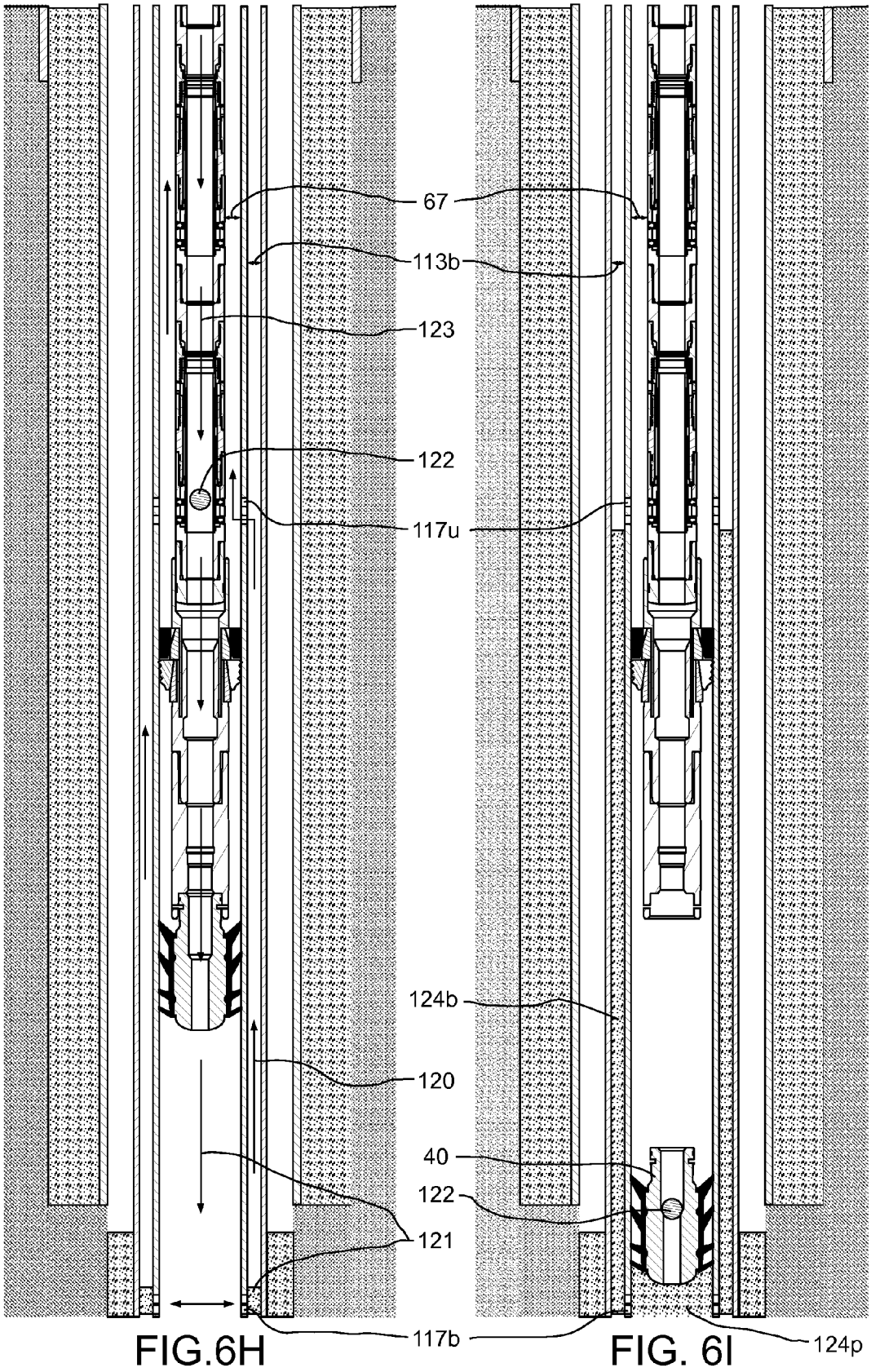

FIG. 6H illustrates pumping cement slurry 121 into the annulus 113*b*. FIG. 6I illustrates launching of the cementing plug 40 of the lower annulus cementing tool 35. A quantity of cement slurry 121 followed by a release plug 122, such as a ball, may then be pumped from the vessel 21 and into the supply fluid conduit 88*n*. The cement slurry 121 and release plug 122 may be driven through the supply fluid conduit 81*n* by chaser fluid 123. The cement slurry 121 and release plug 122 may continue through the conduit 81*n* and fluid sub port 73*p*, through a bore of the PCA 70, and through the bore of the upper annulus cementing tool 90. As the cement slurry 121 flows through the bore of the lower annulus cementing tool 35 and exits into the bore of the production casing 6, the release plug 122 may land in the seat of the cementing plug 40 and continued pumping of the chaser fluid 123 may increase pressure in the bores of the annulus cementing tools 35, 90 until a fluid force exerted thereon is sufficient to fracture the shearable fasteners 41, thereby releasing the cementing plug from the nipple 38. The released cementing plug 40 and seated plug 122 may drive the cement slurry 121 into the B annulus 113*b* via the lower perforations 117*b*. The displaced conditioner 120 may flow from the B annulus 113*b* into the working annulus 67 via the upper perforations 117*u*. The displaced conditioner 120 may continue up the working annulus 67, through the subsea wellhead 10, and into the return fluid conduit 88*o* via the fluid passage 72*p* and conduit 810. The displaced conditioner 120 may continue up the return fluid conduit 88*o* to the vessel 21.

Pumping of the chaser fluid 123 may be halted due to an increase in pressure resulting from the cementing plug 40 reaching the lower perforations 117*b* or once a desired volume of chaser fluid 123 has been pumped. The lower perforations 117*b* may be spaced from the lower bridge plug 33*b* to leave a length of cement slurry 121 in the production casing bore. Densities of the conditioner 121, cement slurry 122, and chaser fluid 123 may correspond so that the cement slurry 121 in the B annulus 113*b* is in a balanced condition. The cement slurry 121 in the B annulus 113*b* and production casing bore may then be allowed to cure, thereby forming respective B annulus cement plug 124*b* and production casing bore plug 124*p*.

Figure 7A:
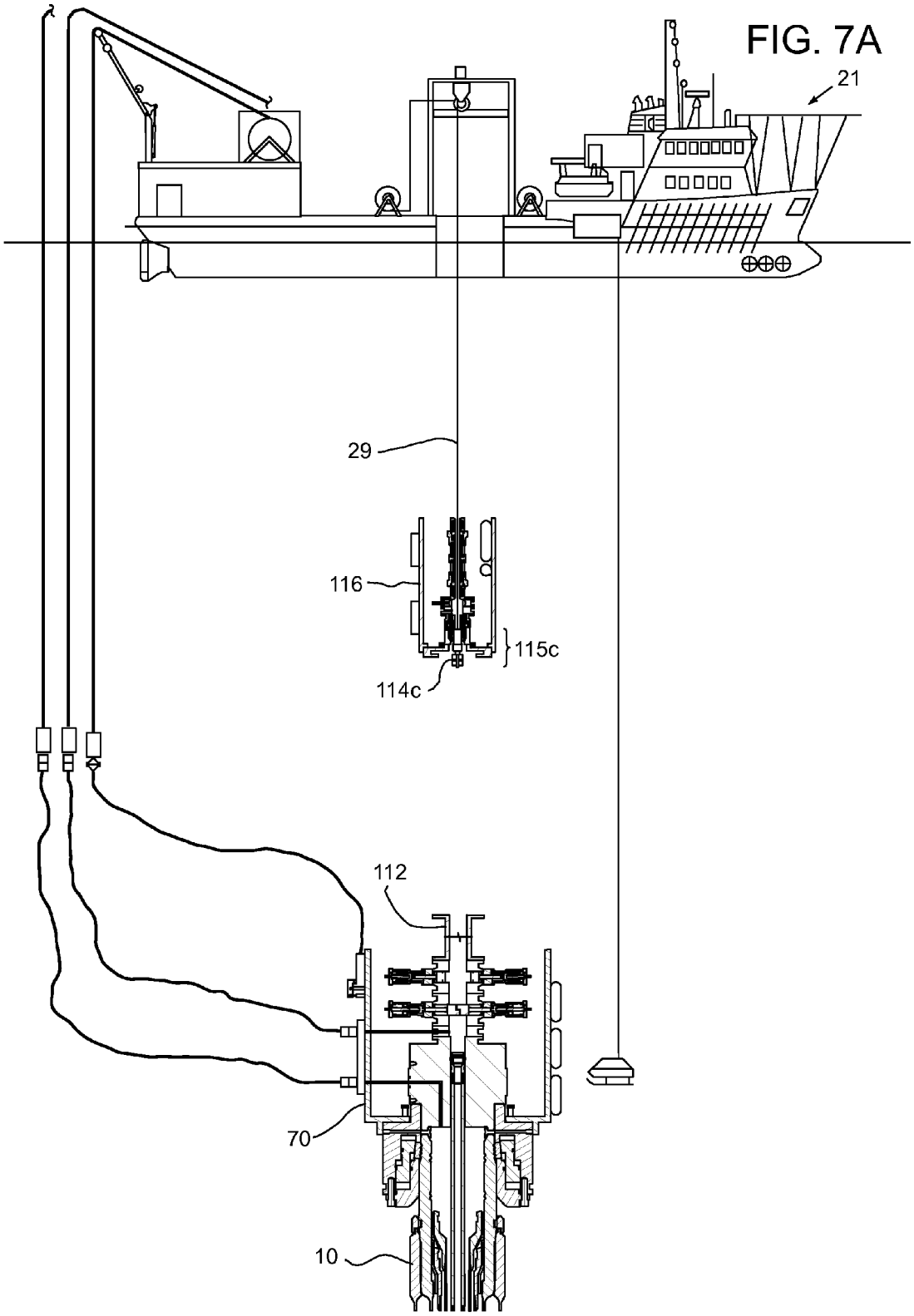
FIGS. 7A-7I illustrate cement plugging of an annulus formed between the intermediate and the surface casing strings.
Figures 7B, 7D:
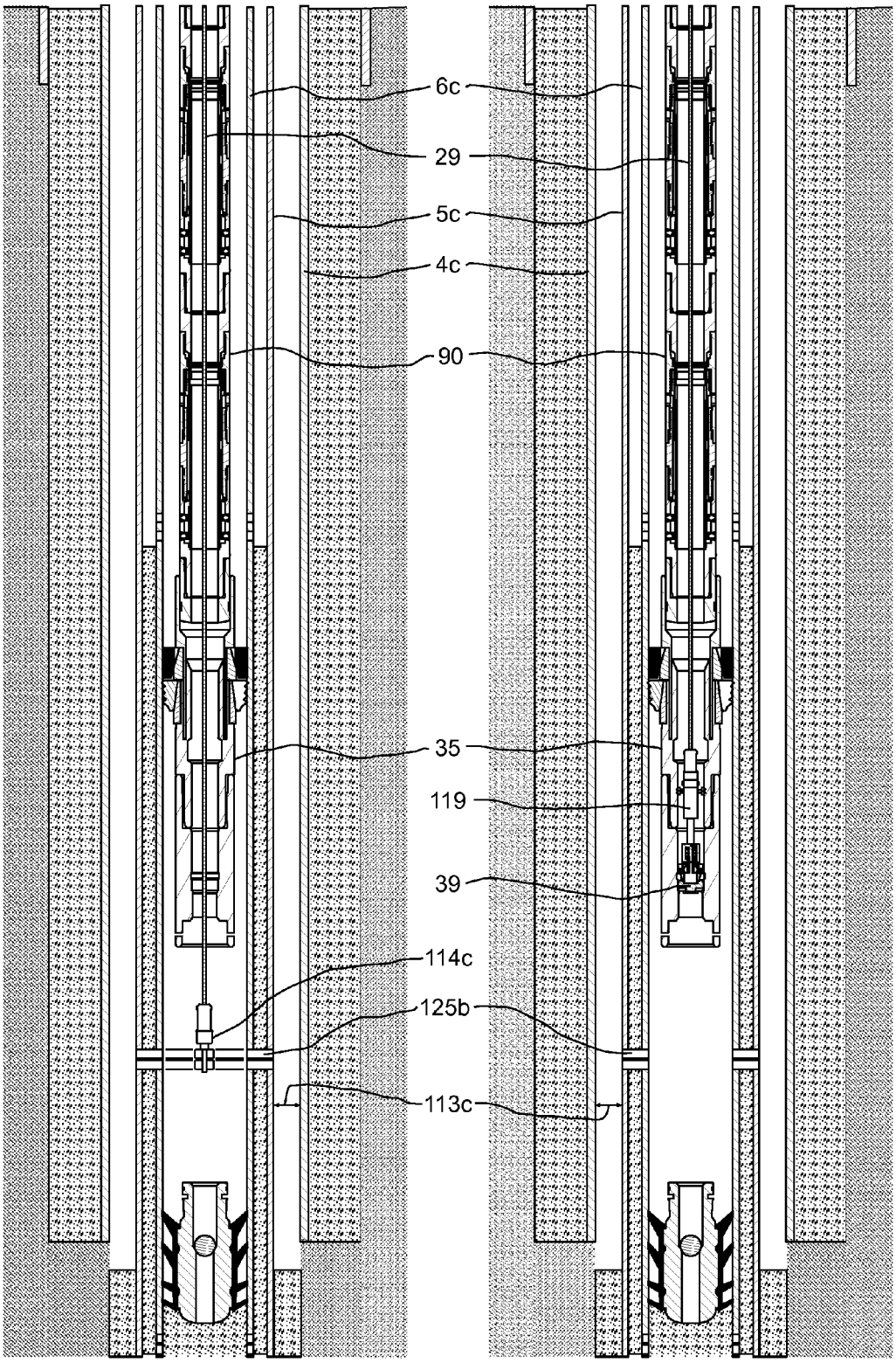
Figure 7C:
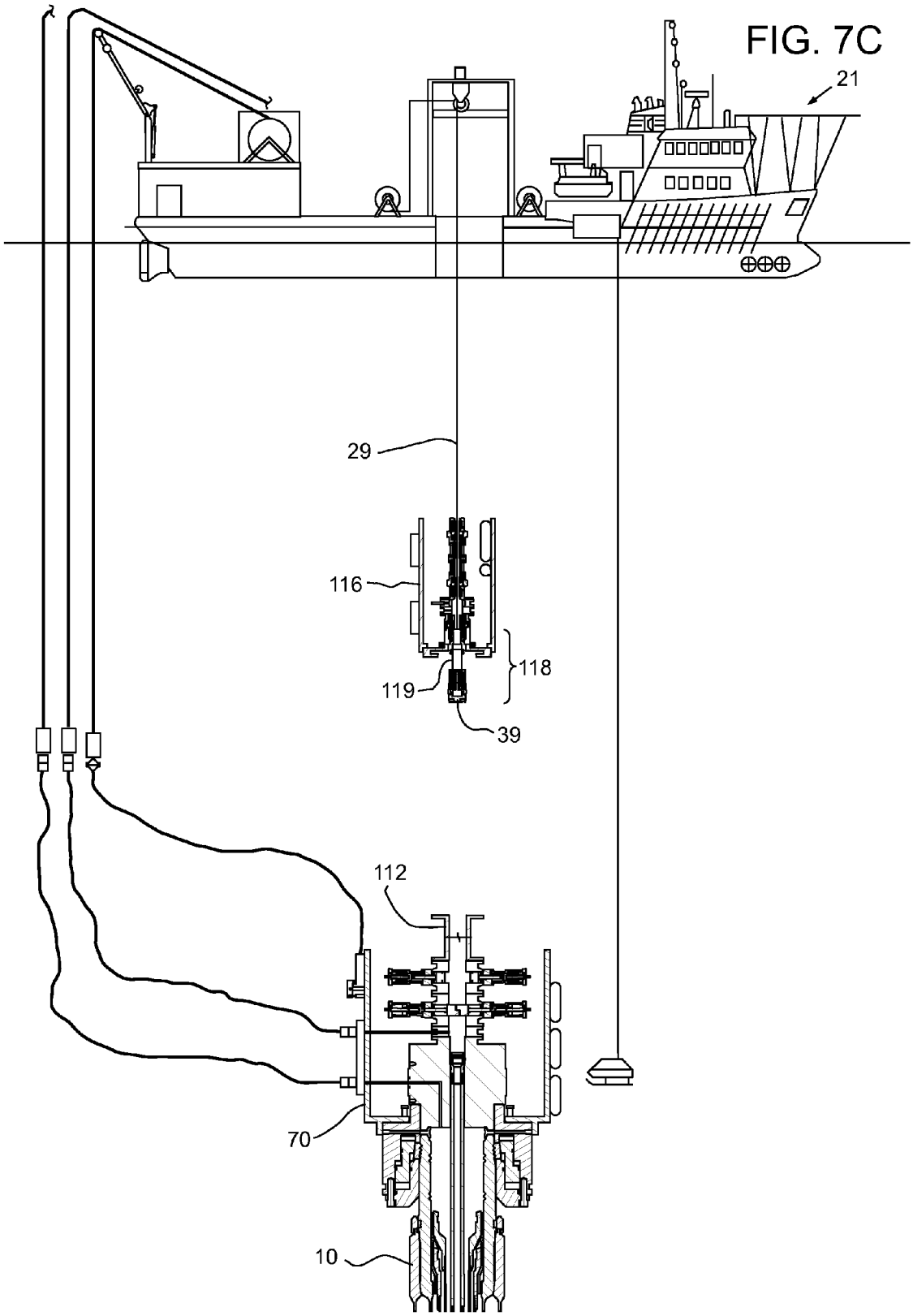
Figures 7E, 7F:
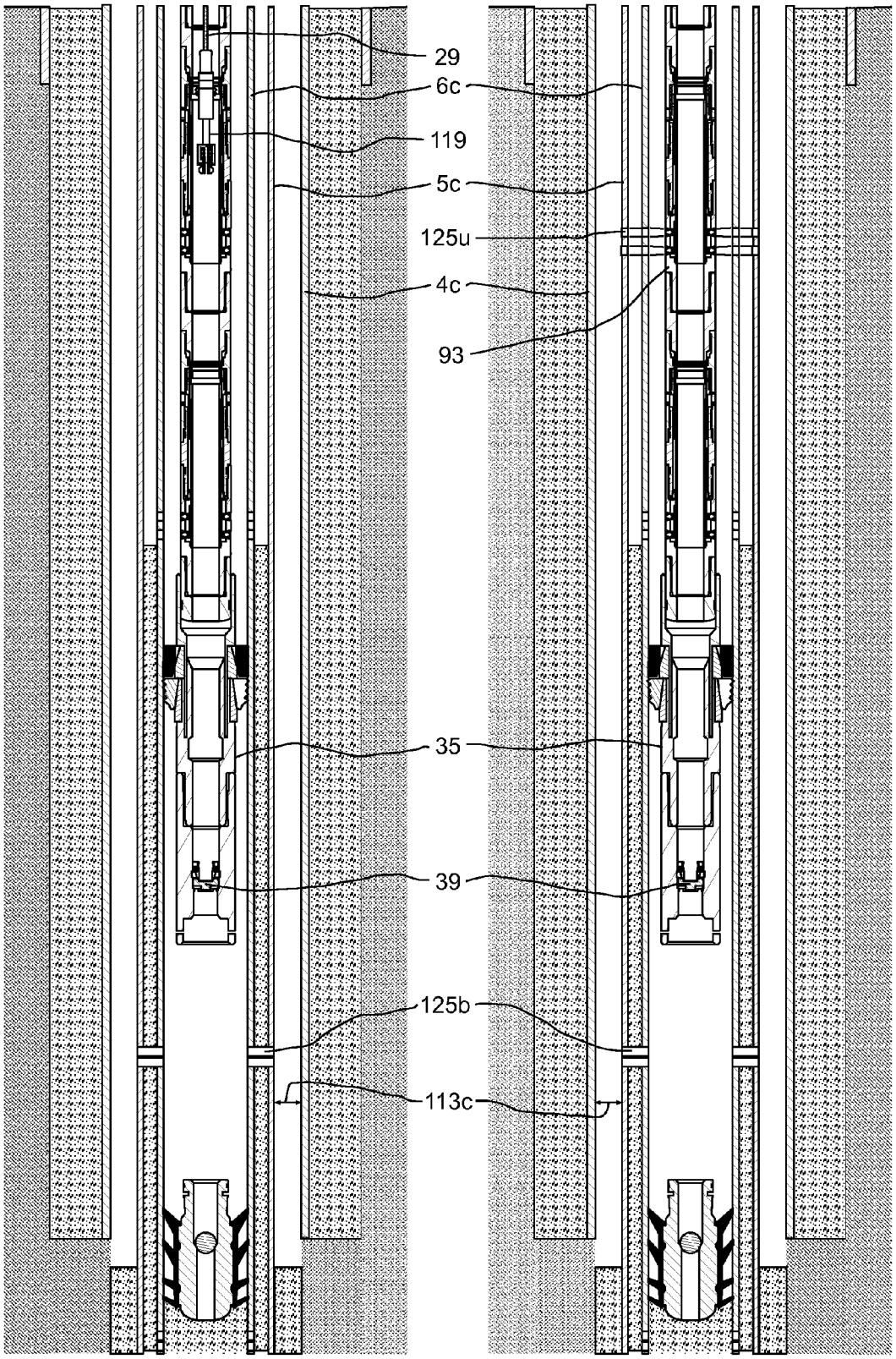

FIGS. 7A-7I illustrate cement plugging of an annulus 113*c* (aka the C annulus) formed between the intermediate 5 and the surface 4 casing strings. FIG. 7A illustrates deployment of a second lower perforating gun 114*c* of the annulus cementing system. Once the B annulus cement plug 124*b* has formed, a ninth BHA 115*c* may be assembled with the lubricator 116, connected to the wireline 29, and deployed to the PCA 70. The ninth BHA 115*c* may be similar to the seventh BHA 115*b* except for having a perforating gun 114*c* instead of the perforating gun 114*b*.

FIG. 7B illustrates firing of the lower perforating gun 114*c* to perforate the production 6 and intermediate 5 casing strings. Once the lubricator 116 has landed onto the PCA 70, the ROV 20 may operate the connector and install the jumper between the lubricator control relay and the PCA 70. The stuffing boxes and grease injector may be activated, the blind-shear BOP 74*b* opened, and the tool catcher operated to release the ninth BHA 115*c*. The ninth BHA 115*c* may then be lowered through the annulus cementing tools 35, 90 to a depth above the cementing plug 40. Once the ninth BHA 115*c* has been deployed to the firing depth, electrical power may then be supplied to via the wireline 29 to fire the perforating gun 114*c* through the production casing 6*c*, through the B annulus cement plug 124*b*, and through a wall of the intermediate casing 5*c*, thereby forming lower perforations 125*b*. The perforating gun 114*c* may be similar to the perforating gun 114*b* except for having shaped charges with a charge strength sufficient to form the lower perforations 125*b* through the wall of the production 5*c* and intermediate 6*c* casings and the B annulus cement plug 124*b* without damaging a wall of the surface casing 4*c*, thereby providing access to the C annulus 113*c*. The ninth BHA 115*c* may then be retrieved to the lubricator 116, the blind-shear BOP 74*b* closed, and the lubricator and seventh BHA 115*b* dispatched from the PCA 70 to the vessel 21.

FIG. 7C illustrates redeployment of the bore plug 39. FIG. 7D illustrates again setting the bore plug 39 in the lower annulus cementing tool 35. FIG. 7E illustrates opening a second isolation sleeve 109 of the upper annulus cementing tool 90. Once the lower perforations 125*b* have been formed, the eighth BHA 118 may be assembled with the lubricator 116 and connected to the wireline 29 and deployed through the open sea 1 to the tool housing 112. Once the lubricator 116 has landed onto the PCA 70, the ROV 20 may operate the connector and install the jumper. The stuffing boxes and grease injector may be activated and then the blind-shear BOP 74*b* opened. The tool catcher may be operated to release the eighth BHA 118 and the eighth BHA 118 may then be lowered through the upper annulus cementing tool 90 and into the lower annulus cementing tool 35 to a depth adjacent the nipple 38. The shifting tool 119 may then be operated via the wireline 29 to install the bore plug 39 into the nipple profile. The shifting tool 119 may then be operated via the wireline 29 to release the bore plug 39 and the eighth BHA 118 (minus the bore plug) raised into the upper annulus cementing tool 90 until the shifter is adjacent to the isolation sleeve 109 of the perforating gun 93. The shifting tool 119 may be operated via the wireline 29 to engage the isolation sleeve 109 and shift the isolation sleeve to the armed position. The eighth BHA 118 (minus the bore plug 39) may then be retrieved to the lubricator 116 and the blind-shear BOP 74*b* closed.

FIG. 7F illustrates firing of a second perforating gun 93 of the upper annulus cementing tool 90 to again perforate the production 6 and intermediate 5 casing strings. Once the perforation gun 93 has been armed, the conditioner 120 (FIG. 6H) may be pumped from the vessel 21, down the supply fluid conduit 88*n*, through the conduit 81*n* and fluid sub port 73*p*, through a bore of the PCA 70, through the bore of the upper annulus cementing tool 90, and against the seated bore plug 39, thereby increasing pressure in the bores of the annulus cementing tools 35, 90 until the firing differential is achieved, thereby firing the perforating gun 93 through the production casing 6*c* and through the wall of the intermediate casing 5*c*, thereby forming upper perforations 125*u* through the wall thereof. The shaped charges 103 of the perforating gun 93 may have a charge strength sufficient to form the upper perforations 125*u* through the walls of the production casing 6*c* and intermediate casing 5*c* without damaging a wall of the surface casing 4*c*, thereby providing further access to the C annulus 113*c*.

Figure 7G:
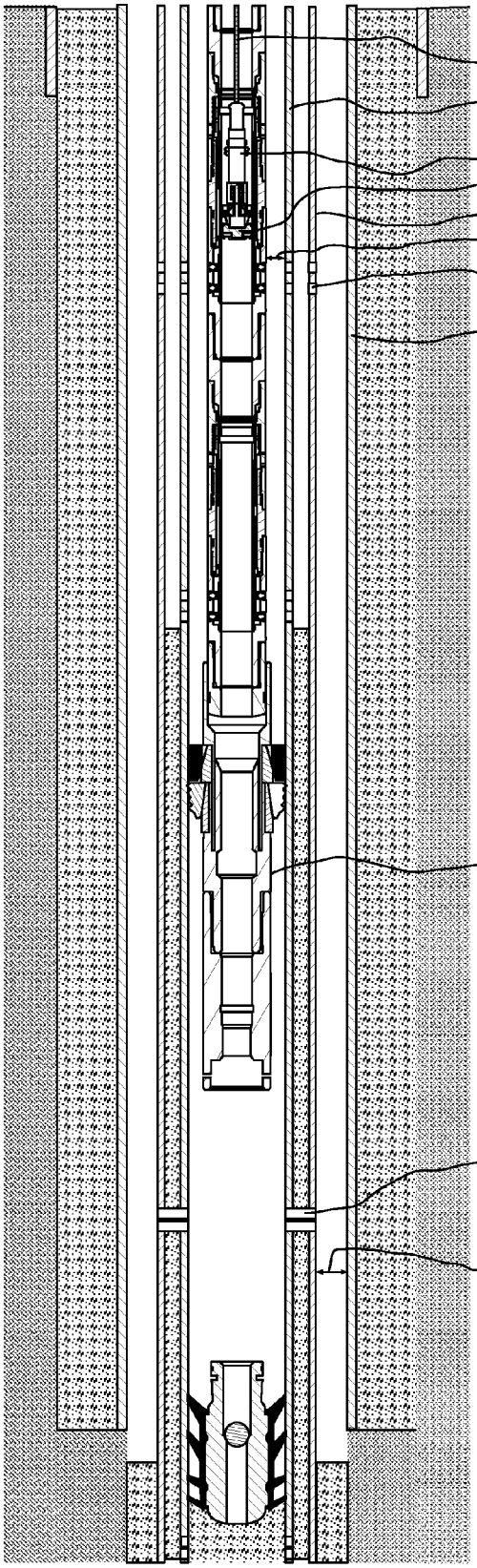

FIG. 7G illustrates repeat retrieval of the bore plug 39 from the lower annulus cementing tool 35. Once the upper perforations 125*u* have been formed, the blind-shear BOP 74*b* may be opened and the eighth BHA 118 (minus the bore plug 39) may then be lowered through the upper annulus cementing tool 90 and into the lower annulus cementing tool 35 to a depth adjacent the nipple 38. The shifting tool 119 may then be operated via the wireline 29 to engage the bore plug 39 and remove the bore plug from the nipple profile. The eighth BHA 118 may then be retrieved to the lubricator 116, the blind-shear BOP 74*b* closed.

Figure 7H:
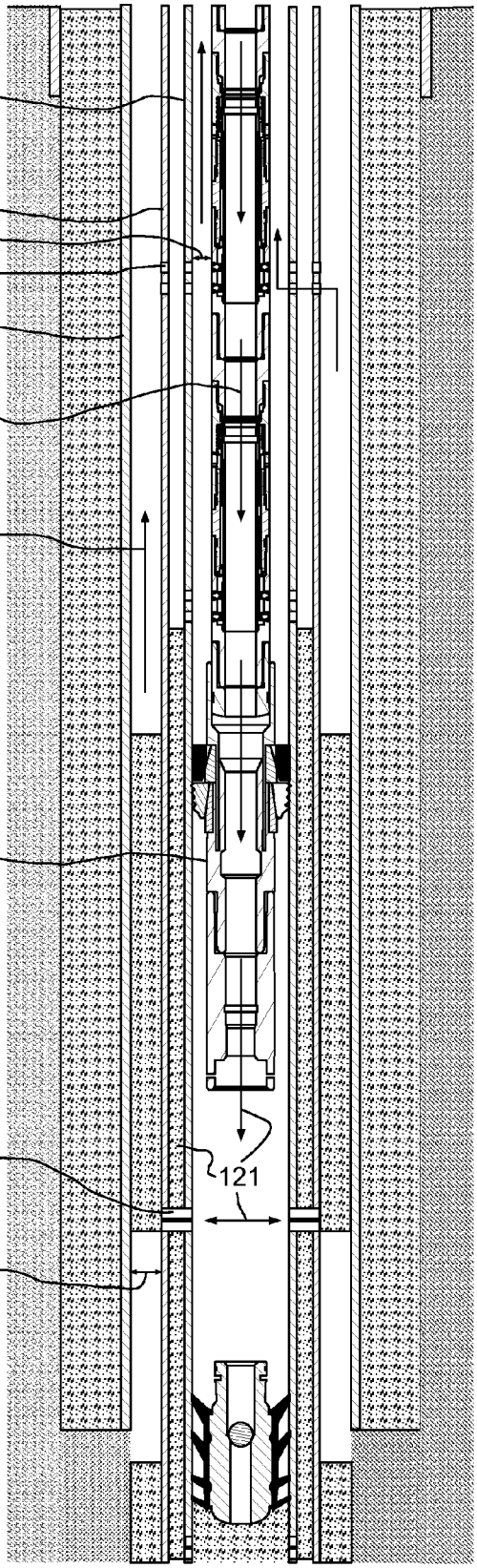
Figure 7I:
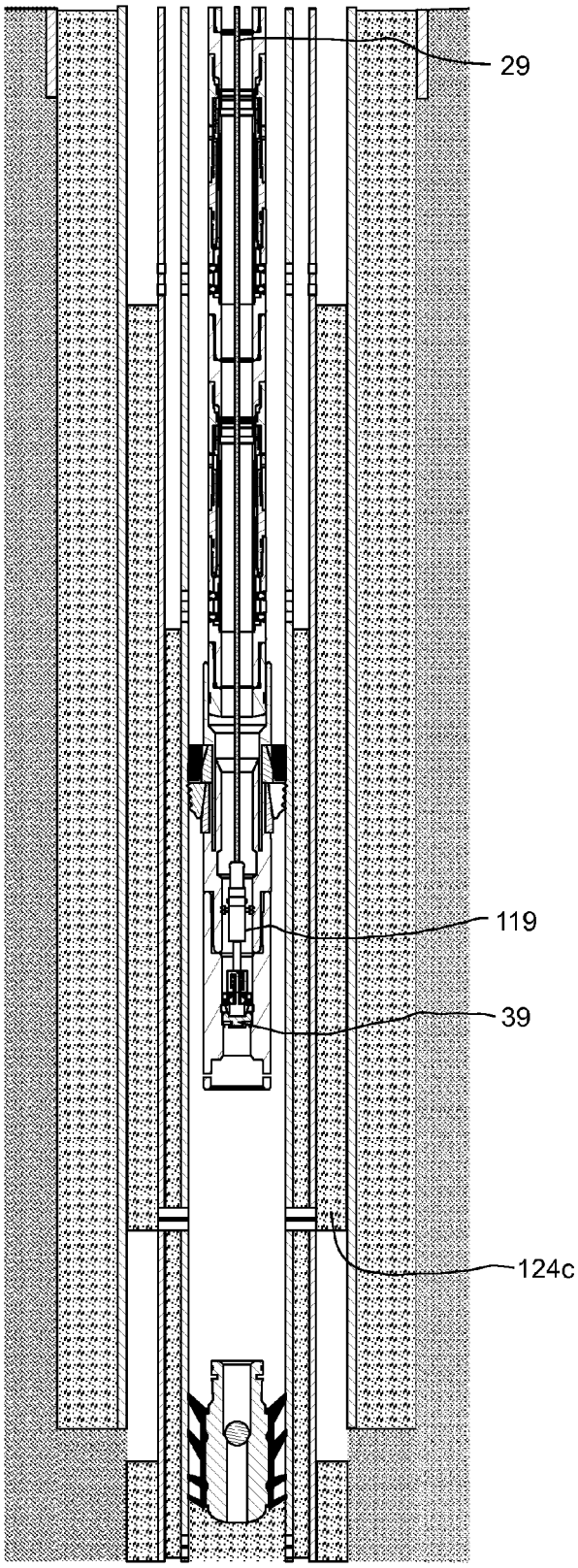

FIG. 7H illustrates pumping cement slurry 121 into the annulus 113*c*. A quantity of cement slurry 121 may then be pumped from the vessel 21 and into the supply fluid conduit 88*n*. The cement slurry 121 may be driven through the supply fluid conduit 81*n* by chaser fluid 123. The cement slurry 121 may continue through the conduit 81*n* and fluid sub port 73*p*, through a bore of the PCA 70, through the bore of the upper annulus cementing tool 90. The cement slurry 121 may continue into the C annulus 113*c* via the lower perforations 125*b*. The displaced conditioner 120 may flow from the C annulus 113*c* into the working annulus 67 via the upper perforations 125*u*. The displaced conditioner 120 may continue up the working annulus 67, through the subsea wellhead 10, and into the return fluid conduit 88*o* via the fluid passage 72*p* and conduit 810. The displaced conditioner 120 may continue up the return fluid conduit 88*o* to the vessel 21. Pumping of the chaser fluid 123 may be halted once a desired volume of chaser fluid 123 has been pumped. Densities of the conditioner 121, cement slurry 122, and chaser fluid 123 may correspond so that the cement slurry 121 in the C annulus 113*c* is in a balanced condition. The cement slurry 121 in the C annulus 113*c* may then be allowed to cure, thereby forming the C annulus cement plug 124*c* (FIG. 7I).

FIG. 7I illustrates again setting the bore plug 39 in the lower annulus cementing tool 35. Once the C annulus cement plug 124*c* has formed, the blind-shear BOP 74*b* may be opened and the eighth BHA 118 (minus the bore plug 39) may then be lowered through the upper annulus cementing tool 90 and into the lower annulus cementing tool 35 to a depth adjacent the nipple 38. The shifting tool 119 may then be operated via the wireline 29 to install the bore plug 39 into the nipple profile. The eighth BHA 118 (minus the bore plug 39) may then be retrieved to the lubricator 116 and the lubricator and eighth BHA dispatched from the PCA 70 to the vessel 21.

Figure 8A:
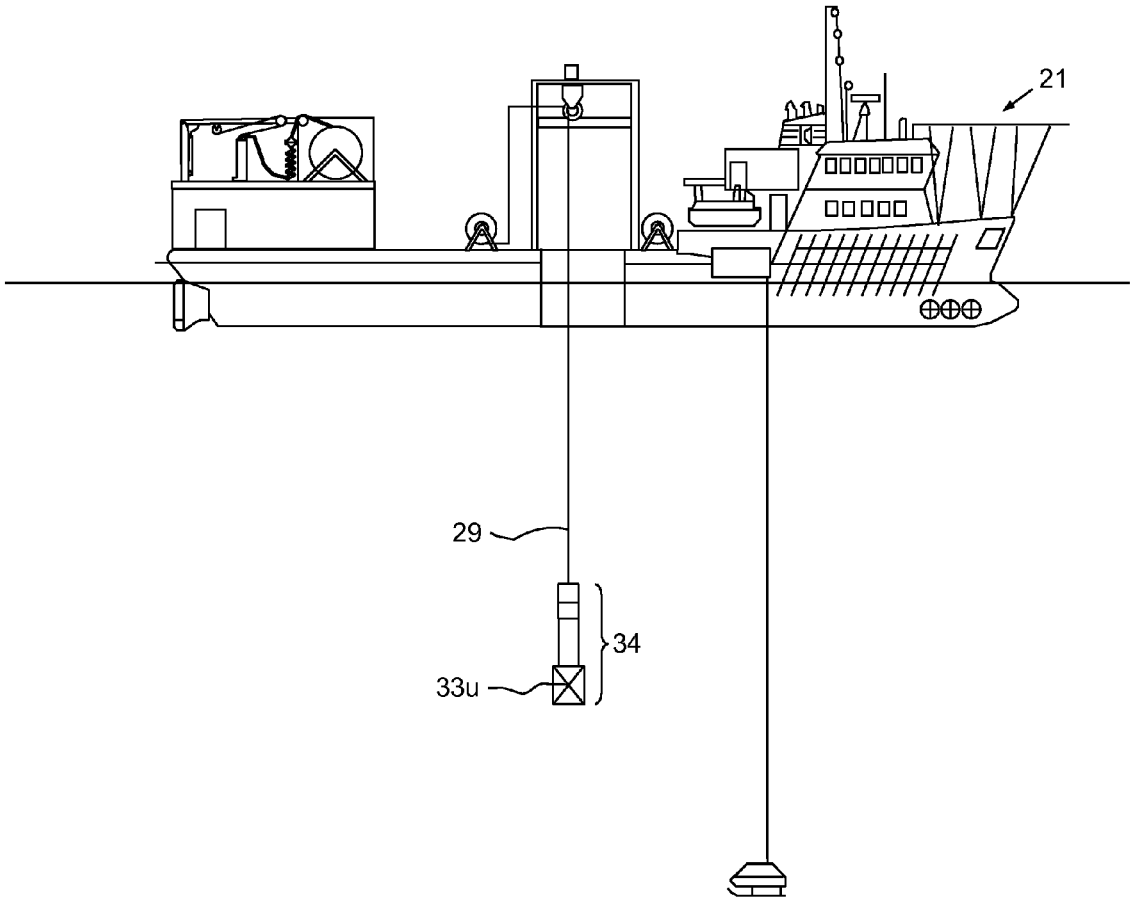
FIGS. 8A-8C illustrate abandonment of the subsea wellhead.
Figure 8A:
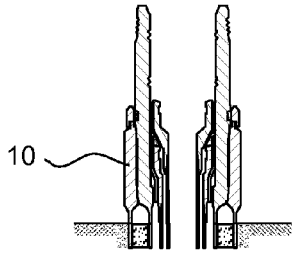
Figure 8B:
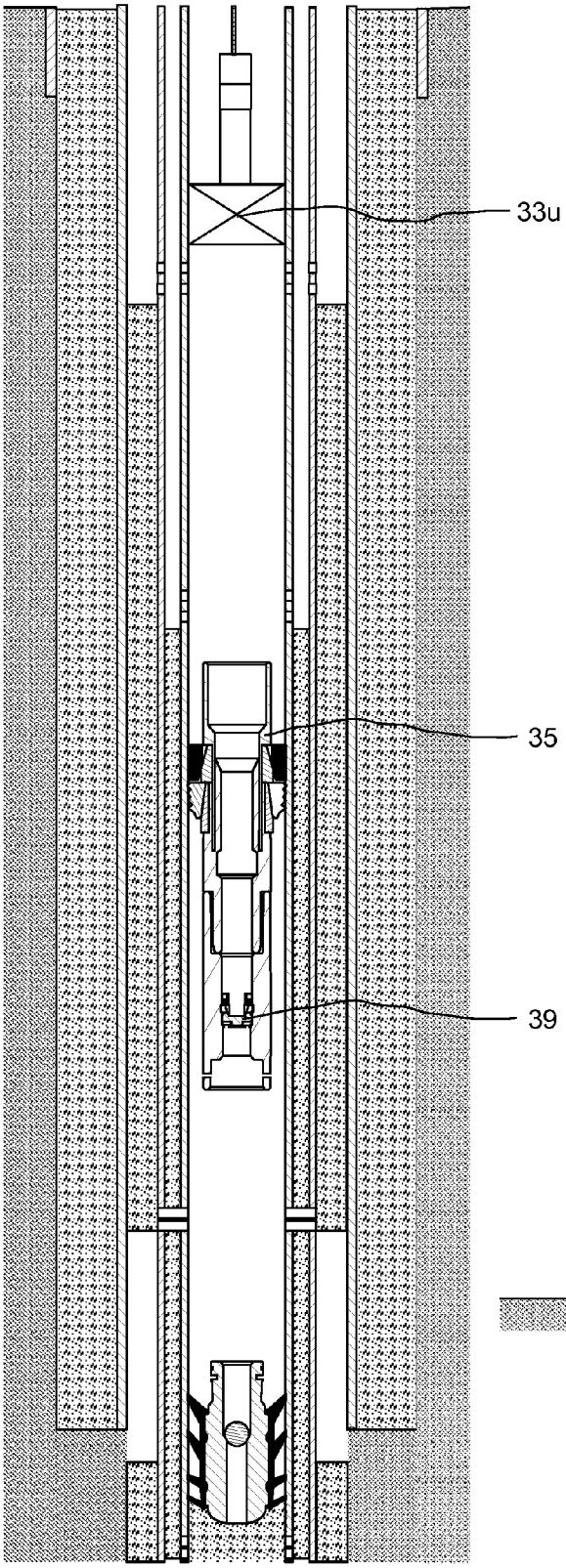
Figure 8C:
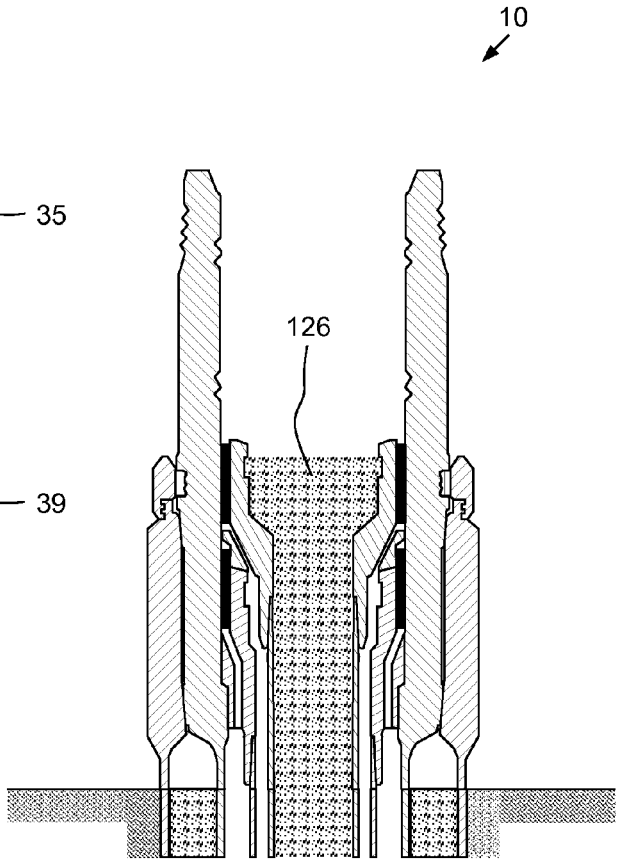

FIGS. 8A-8C illustrate abandonment of the subsea wellhead 10. Once the bore plug 39 has been reinstalled, the grapple 69 may be connected to the wire rope 25 and deployed through the open sea 1 to the tool housing 112. The ROV 20 may guide landing of the grapple 69 onto the tool housing 112. The ROV 20 may then operate the grapple 69 to engage the tool housing 112. The grapple 69 and engaged tool housing 112 may be dispatched from the PCA 70 to the vessel 21. The dry break connections 83*n,o* and the termination head 84*h* may be released from the PCA 70 and the fluid conduits 88*n,o* and the control line 84*u* retrieved to the vessel 21. The grapple 69 may be redeployed through the open sea 1 to the PCA 70. The ROV 20 may then operate the grapple 69 to engage the PCA 70 and operate the wellhead connector 71 to disengage the wellhead 10. The grapple 69 and engaged PCA 70 along with the hung upper annulus cementing tool 90 may be dispatched from the wellhead 10 to the vessel 21.

FIG. 8A illustrates deployment of an upper bridge plug 33*u*. FIG. 8B illustrates setting the upper bride plug 33*u* in the production casing 6*c*. Once the PCA 70 has been retrieved to the vessel 21, the fourth BHA 34 (with the upper bridge plug 33*u*) may be connected to the wireline 29 and deployed through the open sea 1 to the subsea wellhead 10. The fourth BHA 34 may be lowered through the subsea wellhead 10 into the production casing 6*c* and deployed to a depth therein above the upper C annulus perforations 125*u*. Once the fourth BHA 34 has been deployed to the setting depth, electrical power may then be supplied to the BHA via the wireline 29 to operate the setting tool, thereby expanding the upper bridge plug 33*u* against the inner surface of the production casing 6*c*. Once the upper bridge plug 33*u* has been set, the plug may be released from the setting tool by exerting tension on the wireline 29 to fracture the shearable fastener. The fourth BHA 34 (minus the upper bridge plug 33*u*) may then be retrieved to the vessel 21.

FIG. 8C illustrates cement plugging a bore of the production casing 6*c*. Once the upper bridge plug 33*u* has been set, cement slurry may be pumped into the production casing bore down to the upper bridge plug 33*u* and allowed to cure, thereby forming a top cement plug 126. The wellhead 10 may then be left utilizing the casing packoffs as additional barriers.

Figure 9A:
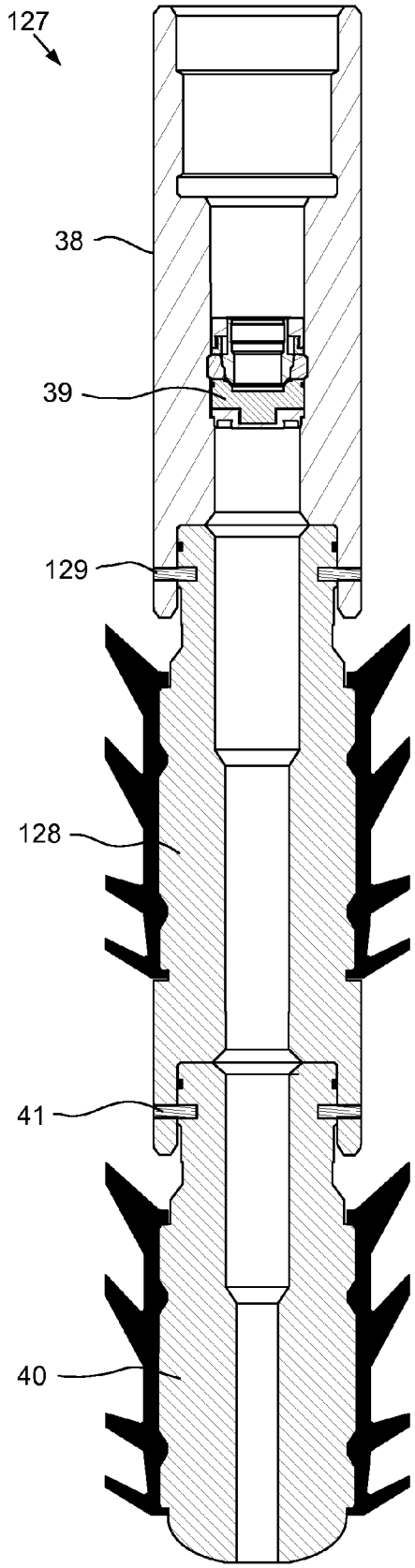
FIG. 9A illustrates a portion of an alternative lower annulus cementing tool having a second cementing plug, according to another embodiment of the present disclosure.

FIG. 9A illustrates a portion of an alternative lower annulus cementing tool 127 having a second cementing plug 128, according to another embodiment of the present disclosure. The alternative lower annulus cementing tool 127 may include the PBR (not shown), the packer (not shown), the nipple 38, the bore plug 39, an upper cementing plug 128, and the lower cementing plug 40.

The upper cementing plug 128 may be a wiper plug including a finned seal and a plug body. The finned seal may be made from an elastomer or elastomeric copolymer and attached to an outer surface of the plug body. The plug body may be tubular, may be made from a metal or alloy, may have an upper stem portion, may have a seat formed in an inner surface thereof, and may have a coupling, such as a lap, formed in a lower end thereof. The stem portion may be received by the nipple lap and one or more (pair shown) shearable fasteners 129 may be inserted into respective sockets formed through a wall of the nipple 38 and received by respective indentations formed in an outer surface of the stem portion, thereby releasably connecting the upper cementing plug 128 and the nipple. The stem portion of the lower cementing plug 40 may be received by the upper cementing plug lap and the shearable fasteners 41 may be inserted into respective sockets formed through a wall of the upper cementing plug 128 and received by the respective indentations formed in an outer surface of the stem portion, thereby releasably connecting the cementing plugs 40, 128. The seat of the upper cementing plug 128 may have a minor diameter greater than or equal to a major diameter of the seat of the lower cementing plug 40 such that the release plug 122 may travel freely through the upper cementing plug 128.

Figure 9B:
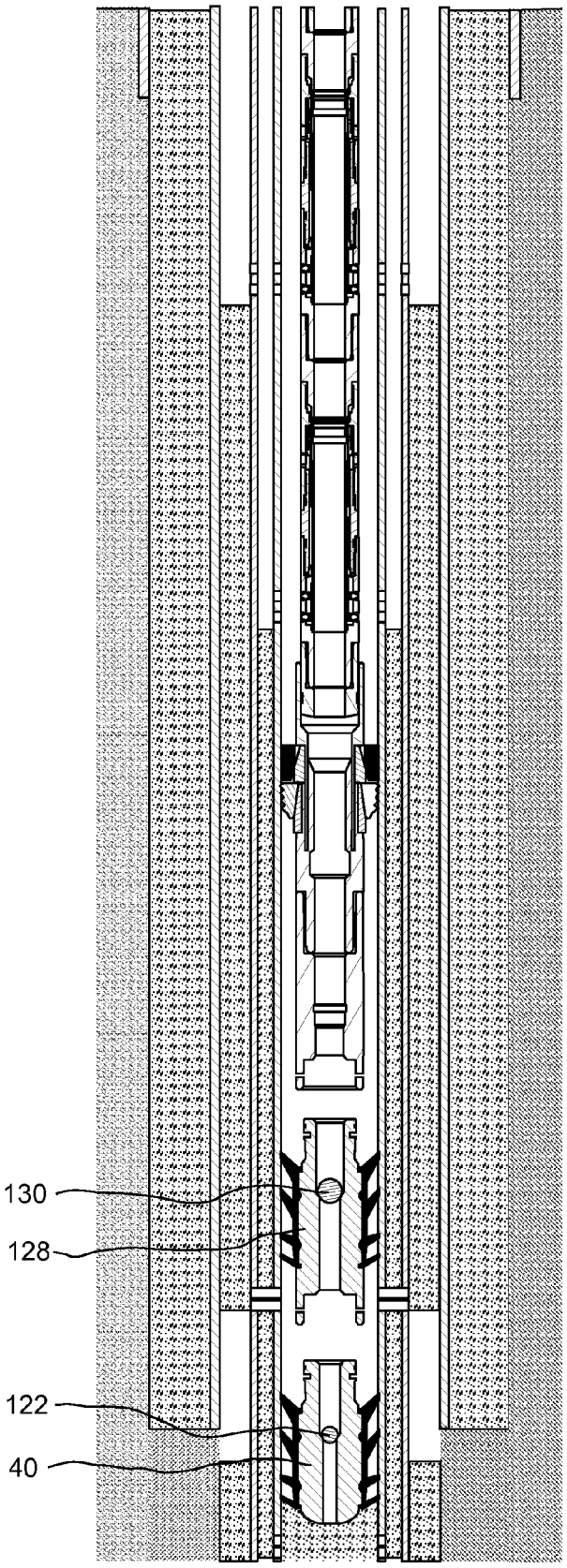
FIG. 9B illustrates cement plugging of the annuli using the alternative lower annulus cementing tool.

FIG. 9B illustrates cement plugging of the annuli 113*b,c* using the alternative lower annulus cementing tool 127. When pumping the cement slurry 121 for the C annulus 113*c*, a second release plug 130, such as a ball, may be pumped from the vessel 21 and into the supply fluid conduit 88*n* between the cement slurry and the chaser fluid 123. The cement slurry 121 and second release plug 130 may be driven through the supply fluid conduit 81*n* by the chaser fluid 123. The cement slurry 121 and second release plug 130 may continue through the conduit 81*n* and fluid sub port 73*p*, through a bore of the PCA 70, and through the bore of the upper annulus cementing tool 90. As the cement slurry 121 flows through the bore of the alternative lower annulus cementing tool 127 and exits into the bore of the production casing 6, the second release plug 130 may land in the seat of the upper cementing plug 128 and continued pumping of the chaser fluid 123 may increase pressure in the bores of the annulus cementing tools 127, 90 until a fluid force exerted thereon is sufficient to fracture the shearable fasteners 129, thereby releasing the upper cementing plug from the nipple 38. The force required to fracture the shearable fasteners 129 may be greater than the force required to fracture the shearable fasteners 41 such that release of the cementing plug 40 does not prematurely release the upper cementing plug 128.

The released upper cementing plug 128 and seated second plug 130 may drive the cement slurry 121 into the C annulus 113*c* via the lower perforations 125*b*. The displaced conditioner 120 may flow from the C annulus 113*c* into the working annulus 67 via the upper perforations 125*u*. The displaced conditioner 120 may continue up the working annulus 67, through the subsea wellhead 10, and into the return fluid conduit 88*o* via the fluid passage 72*p* and conduit 81*o*. The displaced conditioner 120 may continue up the return fluid conduit 88*o* to the vessel 21. Pumping of the chaser fluid 123 may be halted due to an increase in pressure resulting from the upper cementing plug 128 reaching the lower perforations 125*b* or once a desired volume of chaser fluid 123 has been pumped. The cement slurry 121 in the C annulus 113*c* may then be allowed to cure, thereby forming the C annulus cement plug 124*c*.

Figures 10, 11:
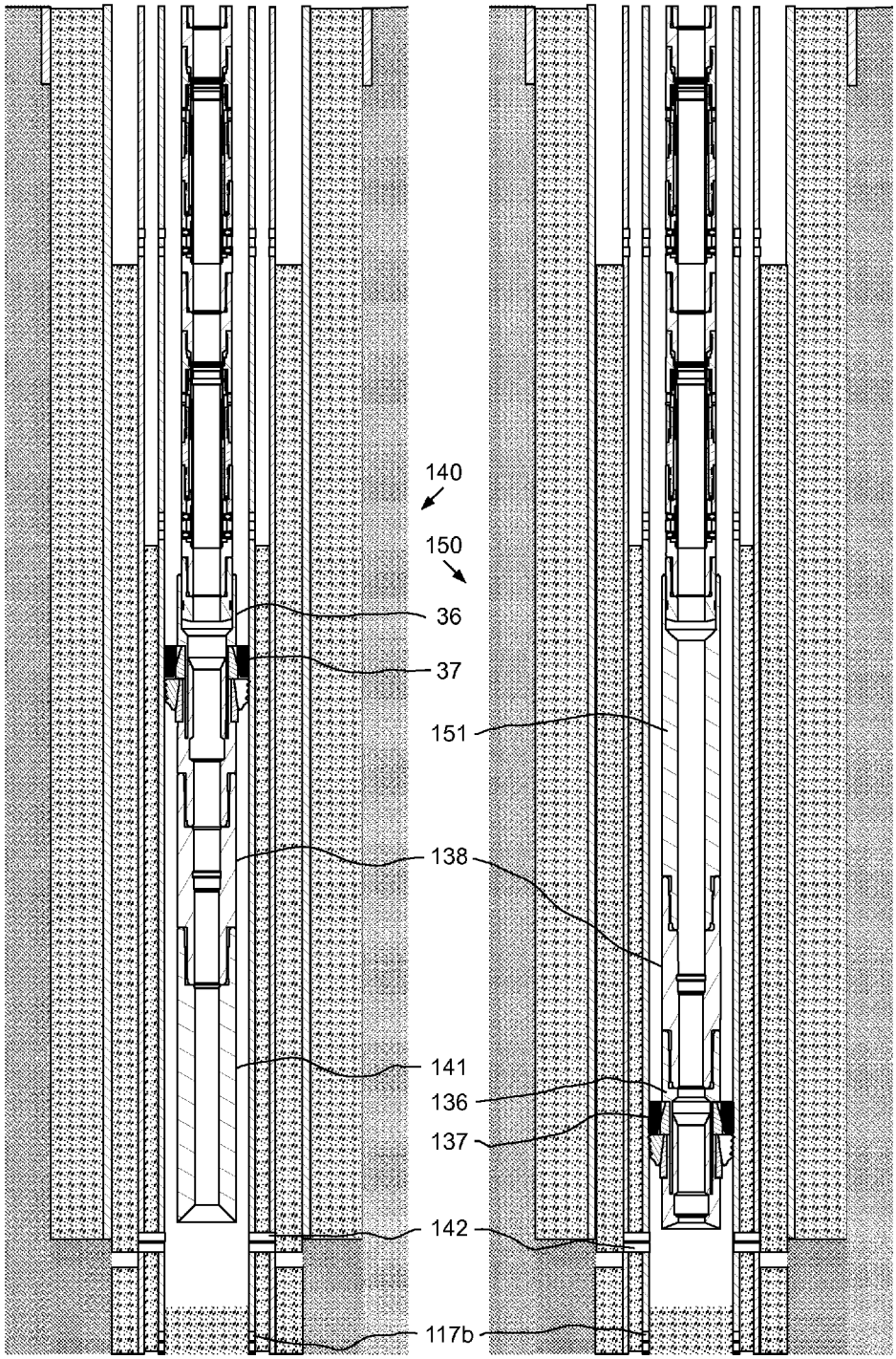
FIG. 10 illustrates a portion of a second alternative lower annulus cementing tool having an extender instead of the cementing plug, according to another embodiment of the present disclosure.
FIG. 11 illustrates a portion of a third alternative lower annulus cementing tool having an extender instead of the cementing plug and having a relocated packer, according to another embodiment of the present disclosure.

FIG. 10 illustrates a portion of a second alternative lower annulus cementing tool 140 having an extender 141 instead of the cementing plug 40, according to another embodiment of the present disclosure. The second alternative lower annulus cementing tool 140 may include the PBR 36, the packer 37, a modified nipple 138, the bore plug (not shown), and the extender 141.

The modified nipple 138 may be tubular, have a coupling, such as a threaded box (shown) or pin (not shown), formed at an upper end thereof and in engagement with the adapter coupling, thereby connecting the nipple and the packer 37. The modified nipple 138 may also have the receiver profile formed in an inner surface thereof for fastening of the bore plug thereto. The modified nipple 138 may also have a coupling, such as a threaded box (not shown) or pin (shown), formed at a lower end thereof and in engagement with a mating upper coupling of the extender 141, thereby connecting the modified nipple and the extender 141. The extender 141 may have an entry guide profile formed in a lower end thereof.

The extender 141 may be tubular and have a bore corresponding to the modified nipple bore 138 and a length sufficient such that the extender lower end is adjacent to and above the lower B annulus 117*b* and lower C annulus 142 perforations. Cementation of the B annulus may be similar to that for the lower annulus cementing tool 35 except for omission of the release plug 122. Cementation of the C annulus may be similar to that for the lower annulus cementing tool 35 except that the lower C annulus perforations 142 may be formed adjacent to (and still above) the lower B annulus perforations 117*b*.

FIG. 11 illustrates a portion of a third alternative lower annulus cementing tool 150 having an extender 151 instead of the cementing plug 40 and having a relocated packer 137, according to another embodiment of the present disclosure. The third alternative lower annulus cementing tool 150 may include the extender 151, an upper adapter 136, a modified packer 137, the modified nipple 138, and the bore plug (not shown).

The extender 151 may be tubular, may have seal bore formed at an upper end thereof for receiving the stinger of the upper annulus cementing tool, and may have a coupling, such as a threaded box (not shown) or pin (shown), formed at a lower end thereof and in engagement with the mating box of the modified nipple 138, thereby connecting the modified nipple and the extender. The upper adapter 136 may be tubular, may have a coupling, such as a threaded box (shown) or pin (not shown), formed at an upper end thereof and in engagement with the mating pin of the modified nipple 138, thereby connecting the modified nipple and the upper adapter 136, and have a coupling, such as a thread, formed adjacent to a lower end thereof for connection with an outer sleeve of the modified packer 137. The modified packer 137 may be similar to the packer 37 except that a lower adapter thereof may have an entry guide profile instead of the pin like the adapter 49.

The extender 151 may have a length sufficient such that the packer lower adapter is adjacent to and above the lower B annulus 117*b* and lower C annulus 142 perforations. Cementation of the B annulus may be similar to that for the lower annulus cementing tool 35 except for omission of the release plug 122. Cementation of the C annulus may be similar to that for the lower annulus cementing tool 35 except that the lower C annulus perforations 142 may be formed adjacent to (and still above) the lower B annulus perforations 117*b*.

Figure 12:
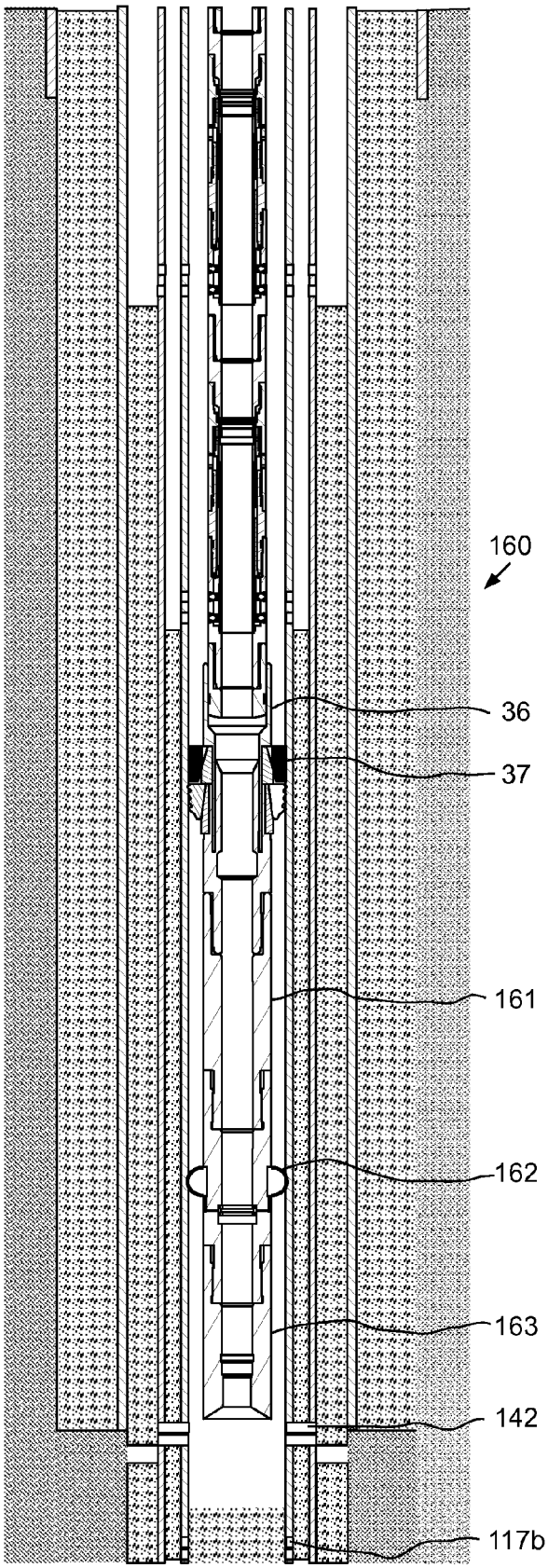
FIG. 12 illustrates a portion of a fourth alternative lower annulus cementing tool having an extender instead of the cementing plug and having a second packer, according to another embodiment of the present disclosure.

FIG. 12 illustrates a portion of a fourth alternative lower annulus cementing tool 160 having an extender 161 instead of the cementing plug 40 and having a second packer 162, according to another embodiment of the present disclosure. The fourth alternative lower annulus cementing tool 160 may include the PBR 36, the (upper) packer 37, an extender 161, the lower packer 162, a modified nipple 163, and the bore plug (not shown).

The extender 161 may be tubular, may have a coupling, such as a threaded box (shown) or pin (not shown), formed at an upper end thereof and in engagement with the mating box of the packer adapter, thereby connecting the extender and the upper packer 37, and may have a coupling, such as a threaded box (not shown) or pin (shown), formed at a lower end thereof and in engagement with a mating box of the lower packer 162, thereby connecting the lower packer and the extender.

The lower packer 162 may include a mandrel, a bladder sleeve, a bladder, and one or more retainers, such as nuts, and an inflator. The mandrel may be tubular and have a flow bore formed therethrough. The mandrel may have a coupling, such as a threaded pin or box, formed at each longitudinal end thereof for connection with the extender 161 at the upper end and for connection with the modified nipple 163 at the lower end. The lower packer 162 may further include various seals disposed between various interfaces thereof. The bladder assembly may be connected to the mandrel, such as by entrapment between shoulders of the mandrel. Each nut may be connected to the bladder sleeve, such as by threaded couplings. Each nut may have a groove formed therein for receiving respective reinforcement elements, such as spring bars. The bladder may be made from an elastomer or elastomeric copolymer. The bladder may be molded onto the assembled nuts, sleeve, and spring bars.

An inner surface of the bladder may be in fluid communication with one or more ports formed through a wall of the bladder sleeve. The ports may provide fluid communication with an inflation passage formed between the bladder sleeve and the mandrel. The inflator may be in fluid communication with the inflation passage. The inflator may include an inflation port formed through a wall of the mandrel, a check valve disposed in the inflation passage, and an isolation sleeve. The check valve may be oriented to allow flow from the inflation port to the inflation passage but to prevent reverse flow therethrough, thereby maintaining inflation of the bladder. The isolation sleeve may be similar to the isolation sleeve 109 and may selectively open or close the inflation ports.

The modified nipple 163 may be tubular, have a coupling, such as a threaded box (shown) or pin (not shown), formed at an upper end thereof and in engagement with the lower packer coupling, thereby connecting the nipple and the lower packer 162. The modified nipple 163 may also have the receiver profile formed in an inner surface thereof for fastening of the bore plug thereto. The modified nipple 163 may also have an entry guide profile formed in a lower end thereof.

Running and installation of the lower annulus cementing tool 160 may be similar to that of the lower annulus cementing tool 35 except for additional steps after setting of the upper packer 37. Before installation of the PCA 70, an inflation tool (not shown) may be deployed using the wireline into the lower annulus cementing tool 160. The inflation tool may be operated to set the bore plug in the modified nipple 163, engage and open the lower packer isolation sleeve, and supply pressurized fluid to the bladder, thereby inflating the bladder. The inflation tool may then close the isolation sleeve and remove the bore plug.

Alternatively, the lower packer 162 may be inflated after installation of the PCA 170 and upper annulus cementing tool 90 and before forming the lower B annulus perforations 117*b* by deploying the shifting tool 119, installing the bore plug, and injecting pressurized inflation fluid into the annulus cementing tools, thereby inflating the bladder. The shifting tool 119 may then remove the bore plug.

The extender 161 may have a length sufficient such that the modified nipple lower end is adjacent to and above the lower B annulus 117*b* and lower C annulus 142 perforations. Cementation of the B annulus may be similar to that for the lower annulus cementing tool 35 except for omission of the release plug 122. Cementation of the C annulus may be similar to that for the lower annulus cementing tool 35 except that the lower C annulus perforations 142 may be formed adjacent to (and still above) the lower B annulus perforations 117*b*.

While the foregoing is directed to embodiments of the present disclosure, other and further embodiments of the disclosure may be devised without departing from the basic scope thereof, and the scope of the invention is determined by the claims that follow.

The invention claimed is:

1. A method for abandonment of a subsea well, comprising:

setting a packer of a lower cementing tool against a bore of an inner casing hung from a subsea wellhead at a location adjacent to an outer casing hung from the subsea wellhead;

fastening a pressure control assembly (PCA) to the subsea wellhead;

hanging an upper cementing tool from the PCA and stabbing the upper cementing tool into a polished bore receptacle of the lower cementing tool;

perforating a wall of the inner casing below the packer;

perforating the wall of the inner casing above the packer by operating a perforator of the upper cementing tool; and pumping cement slurry followed by a release plug through bores of the cementing tools, wherein:

the release plug engages and launches a cementing plug from the lower cementing tool, and the cementing plug drives the cement slurry through the perforations below the packer and into an inner annulus formed between the inner casing and the outer casing.

2. The method of claim 1, wherein the wall of the inner casing is perforated below the packer before being perforated above the packer.

3. The method of claim 1, further comprising:

setting a bore plug in a nipple of the lower cementing tool; and arming the perforator by opening an isolation sleeve thereof, wherein the perforator is operated by pressurizing the bores of the cementing tools against the set bore plug.

4. The method of claim 1, further comprising:

severing an upper portion of production tubing from a lower portion thereof; and retrieving the severed portion from the subsea well, wherein the packer is set, the PCA is fastened, the upper cementing tool is hung, the bore is closed, the inner casing is perforated, and the cement slurry is pumped after retrieving the severed portion from the subsea well.

5. The method of claim 4, wherein the severed portion is retrieved by retrieving a production tree from the subsea wellhead.

6. The method of claim 1, wherein the PCA comprises a blowout preventer stack.

7. The method of claim 1, further comprising setting a bridge plug in the bore of the inner casing before setting the packer.

8. The method of claim 1, further comprising:

fastening a tool housing to the PCA; and after fastening the tool housing to the PCA:

deploying a second perforator through open sea with a lubricator and wireline;

fastening the lubricator to the tool housing; and lowering the second perforator through the bores of the cementing tool, wherein the wall of the inner casing is perforated below the packer by operating the second perforator using the wireline.

9. The method of claim 1, further comprising perforating walls of the inner and outer casings below the packer after curing of the cement slurry and through the cured cement.

10. The method of claim 9, further comprising perforating the inner and outer casing walls above the packer by operating a second perforator of the upper cementing tool.

11. The method of claim 10, further comprising pumping a second cement slurry through the bores of the cementing tools and into an outer annulus formed between the outer casing and a third casing hung from the subsea wellhead.

12. The method of claim 11, further comprising following the second cement slurry with a second release plug, wherein the second release plug engages and launches a second cementing plug from the lower cementing tool.

13. The method of claim 1, further comprising deploying the lower cementing tool through open sea to the subsea wellhead before fastening the PCA to the subsea wellhead.

14. The method of claim 1, wherein the method is performed riserlessly.

15. The method of claim 1, further comprising, after curing of the cement slurry:

retrieving the PCA and the upper cementing tool;

setting a bridge plug in the bore of the inner casing; and forming a cement plug on the set bridge plug.

16. A method for abandonment of a subsea well, comprising:

setting a packer of a lower cementing tool against a bore of an inner casing hung from a subsea wellhead at a location adjacent to an outer casing hung from the subsea wellhead;

fastening a pressure control assembly (PCA) to the subsea wellhead;

hanging an upper cementing tool from the PCA and stabbing the upper cementing tool into a polished bore receptacle of the lower cementing tool;

perforating a wall of the inner casing below the packer and adjacent to a lower end of the lower cementing tool;

perforating the wall of the inner casing above the packer by operating a perforator of the upper cementing tool; and pumping cement slurry through bores of the cementing tools, through the perforations below the packer, and into an inner annulus formed between the inner casing and the outer casing.

17. The method of claim 16, wherein the packer is located at the lower end of the lower cementing tool.

18. The method of claim 16, further comprising inflating a second packer of the lower cementing tool.

* * * * *